US009129487B2

(12) United States Patent
Snow et al.

(10) Patent No.: US 9,129,487 B2
(45) Date of Patent: Sep. 8, 2015

(54) VARIANT OF TEXAS HOLD 'EM POKER

(71) Applicant: Bally Gaming, Inc., Las Vegas, NV (US)

(72) Inventors: Roger M. Snow, Las Vegas, NV (US); Louis J. Castle, II, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 11 days.

(21) Appl. No.: 14/034,284

(22) Filed: Sep. 23, 2013

(65) Prior Publication Data

US 2014/0087804 A1 Mar. 27, 2014

Related U.S. Application Data

(60) Continuation-in-part of application No. 13/631,816, filed on Sep. 28, 2012, which is a continuation-in-part of application No. 13/455,742, filed on Apr. 25, 2012, which is a division of application No. 11/156,352, filed on Jun. 17, 2005, now abandoned.

(51) Int. Cl.
*A63F 1/00* (2006.01)
*G07F 17/32* (2006.01)

(52) U.S. Cl.
CPC ..... *G07F 17/3293* (2013.01); *G07F 17/326* (2013.01); *G07F 17/3223* (2013.01)

(58) Field of Classification Search
CPC ..... A63F 1/00
USPC ..... 273/292; 463/13
See application file for complete search history.

(56) References Cited

U.S. PATENT DOCUMENTS

| | | | |
|---|---|---|---|
| 4,743,022 | A | 5/1988 | Wood |
| 4,836,553 | A | 6/1989 | Suttle et al. |
| 4,861,041 | A | 8/1989 | Jones et al. |
| 5,022,653 | A | 6/1991 | Suttle et al. |
| 5,046,736 | A | 9/1991 | Bridgeman et al. |
| 5,098,107 | A | 3/1992 | Boylan et al. |

(Continued)

FOREIGN PATENT DOCUMENTS

| | | | |
|---|---|---|---|
| AU | 200135060 | A1 | 10/2001 |
| AU | 2006202691 | A1 | 1/2007 |

(Continued)

OTHER PUBLICATIONS

"Live Casino Gaming," The Riverside Resort, http://www.riversideresort.com/Gaming/live-games.htm (accessed Jan. 16, 2007); "Wild Hold'em Fold'em Stud Poker," http://www.riversideresort.com/Gaming/Pit/holdem.htm (1998), 4 pages.

(Continued)

*Primary Examiner* — Michael Dennis
(74) *Attorney, Agent, or Firm* — TraskBritt

(57) ABSTRACT

An online variant of the game of Hold 'Em poker allows one or all of the players to remain in a game with an option of checking or making specific wagering amounts in first play wagers, being limited in the size of subsequent available play wagers or prohibited from making additional play wagers if a first play wager has been made, being limited in the size of available later play wagers if a first or earlier play wager has been made, and having the opportunity for at least two and as many as three or four distinct opportunities in the stages in the play of a hand to be able to make one or more play wagers.

16 Claims, 10 Drawing Sheets

(56) References Cited

U.S. PATENT DOCUMENTS 5,100,137 A 3/1992 Fulton
5,167,413 A 12/1992 Fulton
5,174,579 A 12/1992 Griffiths
5,221,083 A 6/1993 Dote
5,242,163 A 9/1993 Fulton
5,251,897 A 10/1993 Fulton
5,255,915 A 10/1993 Miller
5,257,784 A 11/1993 Boylan et al.
5,257,810 A 11/1993 Schorr et al.
5,265,877 A 11/1993 Boylan et al.
5,275,415 A 1/1994 Wisted
5,288,081 A 2/1994 Breeding
5,294,128 A 3/1994 Marquez
5,308,065 A 5/1994 Bridgeman et al.
5,322,295 A 6/1994 Cabot et al.
5,324,035 A 6/1994 Morris et al.
5,366,228 A 11/1994 Kangsanaraks
5,377,973 A 1/1995 Jones et al.
5,377,994 A 1/1995 Jones
5,380,012 A 1/1995 Jones et al.
5,395,120 A 3/1995 Malek
5,397,128 A 3/1995 Hesse et al.
5,411,257 A 5/1995 Fulton
5,413,353 A 5/1995 Demarest et al.
5,415,414 A 5/1995 Savage
5,417,430 A 5/1995 Breeding
5,423,551 A 6/1995 Stavinsky
5,431,408 A 7/1995 Adams
5,437,451 A 8/1995 Fulton
5,489,101 A 2/1996 Moody
5,494,295 A 2/1996 Potter et al.
5,505,449 A 4/1996 Eberhardt et al.
5,531,448 A 7/1996 Moody
5,538,252 A 7/1996 Green
5,584,486 A 12/1996 Franklin
5,603,502 A 2/1997 Nakagawa
5,630,757 A 5/1997 Gagin et al.
5,636,842 A 6/1997 Cabot et al.
5,653,444 A 8/1997 Dahl
5,657,993 A 8/1997 Merlino et al.
5,660,393 A 8/1997 Dreger
5,669,817 A 9/1997 Tarantino
5,673,917 A 10/1997 Vancura
5,685,774 A 11/1997 Webb
5,697,614 A 12/1997 Potter et al.
5,707,286 A 1/1998 Carlson
5,711,525 A 1/1998 Breeding
5,718,430 A 2/1998 Aramapakul et al.
5,732,950 A 3/1998 Moody
5,741,183 A 4/1998 Acres et al.
5,752,702 A 5/1998 McDoniel
5,762,340 A 6/1998 Feola
RE35,864 E 7/1998 Weingardt
5,820,460 A 10/1998 Fulton
5,830,069 A 11/1998 Soltesz et al.
5,839,732 A 11/1998 Guidi
5,845,906 A 12/1998 Wirth
5,851,011 A 12/1998 Lott
5,851,149 A 12/1998 Xidos et al.
5,871,213 A 2/1999 Chadband et al.
5,897,436 A 4/1999 Singer et al.
5,901,958 A 5/1999 Andrews
5,928,081 A 7/1999 Bochichio et al.
5,975,529 A 11/1999 de Keller
5,988,643 A 11/1999 Awada
5,997,002 A 12/1999 Goldman
6,012,719 A 1/2000 Webb
6,027,119 A 2/2000 De Lisle
6,042,118 A 3/2000 Poitra
6,056,641 A 5/2000 Webb
6,102,402 A 8/2000 Scott et al.
6,113,101 A 9/2000 Wirth
6,113,103 A 9/2000 Mostashari
6,142,872 A 11/2000 Walker et al.
6,170,827 B1 1/2001 Lombardo et al.
6,196,918 B1 3/2001 Miers et al.
6,206,373 B1 3/2001 Garrod
6,206,780 B1 3/2001 Awada
6,210,274 B1 4/2001 Carlson
6,229,534 B1 5/2001 Gerra et al.
6,237,916 B1 5/2001 Webb
6,272,223 B1 8/2001 Carlson
6,273,424 B1 8/2001 Breeding
6,279,910 B1 8/2001 de Keller
6,325,375 B1 12/2001 Potter et al.
6,332,614 B1 12/2001 Hesse
6,336,859 B2 1/2002 Jones et al.
6,345,823 B1 2/2002 Webb
6,375,189 B1 4/2002 Jones
6,406,024 B1 6/2002 Perkins
6,409,602 B1 6/2002 Wiltshire et al.
6,428,005 B2 8/2002 Au-Yeung
6,467,771 B1 10/2002 deKeller
6,517,072 B1 2/2003 McInerney
6,533,658 B1 3/2003 Walker
6,561,897 B1 5/2003 Bourbour et al.
6,581,936 B1 6/2003 Zoccolillo et al.
6,607,443 B1 8/2003 Miyamoto et al.
6,637,747 B1 10/2003 Garrod
6,651,981 B2 11/2003 Grauzer et al.
6,698,759 B2 3/2004 Webb et al.
6,705,943 B2 3/2004 Awada
6,712,702 B2 3/2004 Goldberg et al.
6,719,291 B1 4/2004 deKeller
6,749,510 B2 6/2004 Giobbi
6,752,394 B2 6/2004 Malcolm
6,755,741 B1 6/2004 Rafaeli
6,758,751 B2 7/2004 Soltys et al.
6,827,348 B1 12/2004 Mitchell
6,896,265 B1 5/2005 Schlumbrecht
6,899,628 B2 5/2005 Leen et al.
6,976,589 B2 12/2005 De Raedt et al.
6,986,514 B2 1/2006 Snow
7,011,309 B2 3/2006 Soltys et al.
7,029,011 B2 4/2006 Strong et al.
7,056,215 B1 6/2006 Olive
7,108,603 B2 9/2006 Olive
7,128,652 B1 10/2006 Lavoie et al.
7,140,614 B2 11/2006 Snow
7,140,964 B2 11/2006 Walker
7,175,522 B2 2/2007 Hartl
7,186,181 B2 3/2007 Rowe
7,189,161 B1 3/2007 Wiltshire et al.
7,203,841 B2 4/2007 Jackson et al.
7,246,799 B2 7/2007 Snow
7,261,298 B1 8/2007 Schlumbrecht
7,264,243 B2 9/2007 Yoseloff et al.
7,297,062 B2 11/2007 Gatto et al.
7,303,473 B2 12/2007 Rowe
7,387,300 B2 6/2008 Snow
7,438,295 B2 10/2008 Aida
7,510,191 B1 3/2009 Schlumbrecht
7,510,193 B1 * 3/2009 Schlumbrecht ..... 273/292
7,510,478 B2 3/2009 Benbrahim et al.
7,515,718 B2 4/2009 Nguyen et al.
7,516,959 B2 4/2009 Huard et al.
7,537,456 B2 5/2009 Snow
7,584,966 B2 9/2009 Snow
7,584,968 B2 9/2009 Campbell et al.
7,611,404 B1 11/2009 Hilf et al.
7,628,689 B2 12/2009 Snow
7,661,676 B2 2/2010 Smith et al.
7,666,095 B2 2/2010 Van Luchene
7,722,048 B2 5/2010 Smith et al.
7,744,452 B2 6/2010 Cimring et al.
7,780,529 B2 8/2010 Rowe et al.
7,794,319 B2 9/2010 Luciano, Jr. et al.
7,824,255 B2 11/2010 Lutnick et al.
7,846,018 B2 12/2010 Baerlocher
7,867,091 B2 1/2011 Moshal
7,871,323 B2 1/2011 Walker et al.
7,874,901 B2 1/2011 Kirkpatrick
7,905,770 B2 3/2011 Snow
7,909,689 B2 3/2011 Lardie

(56) References Cited

U.S. PATENT DOCUMENTS

| | | | |
|---|---|---|---|
| 7,931,533 | B2 | 4/2011 | LeMay et al. |
| 7,946,911 | B2 | 5/2011 | Vang et al. |
| 7,988,554 | B2 | 8/2011 | LeMay et al. |
| 8,062,134 | B2 | 11/2011 | Kelly et al. |
| 8,092,289 | B2 | 1/2012 | Mai |
| 8,092,307 | B2 | 1/2012 | Kelly |
| 8,092,309 | B2 | 1/2012 | Bickley |
| 8,172,661 | B1 | 5/2012 | Hein |
| 8,590,900 | B2 | 11/2013 | Yoseloff |
| 2001/0040345 | A1 | 11/2001 | Au-Yeung |
| 2001/0048197 | A1 | 12/2001 | Lo |
| 2002/0049909 | A1 | 4/2002 | Jackson et al. |
| 2002/0103018 | A1 | 8/2002 | Rommerdahl et al. |
| 2002/0175468 | A1 | 11/2002 | Kenny et al. |
| 2002/0190469 | A1 | 12/2002 | Conklin et al. |
| 2002/0195775 | A1 | 12/2002 | Webb et al. |
| 2003/0176209 | A1 | 9/2003 | Soltys et al. |
| 2003/0199316 | A1 | 10/2003 | Miyamoto et al. |
| 2004/0023712 | A1 | 2/2004 | Oliver |
| 2004/0036217 | A1 | 2/2004 | Schlumbrecht |
| 2004/0100025 | A1 | 5/2004 | Conklin et al. |
| 2004/0150163 | A1 | 8/2004 | Kenny et al. |
| 2004/0160006 | A1 | 8/2004 | Kenny et al. |
| 2004/0178582 | A1 | 9/2004 | Garrod |
| 2004/0180722 | A1 | 9/2004 | Giobbi |
| 2004/0204231 | A1 | 10/2004 | Martin et al. |
| 2004/0217548 | A1 | 11/2004 | Snow |
| 2004/0224777 | A1 | 11/2004 | Smith et al. |
| 2005/0032564 | A1 | 2/2005 | Sines |
| 2005/0051958 | A1 | 3/2005 | Snow |
| 2005/0104292 | A1 | 5/2005 | Schultz |
| 2005/0107148 | A1 | 5/2005 | Webb |
| 2005/0143166 | A1 | 6/2005 | Walker et al. |
| 2005/0164759 | A1 | 7/2005 | Smith et al. |
| 2005/0164762 | A1 | 7/2005 | Smith et al. |
| 2005/0192092 | A1 | 9/2005 | Breckner et al. |
| 2005/0242506 | A1 | 11/2005 | Yoseloff |
| 2006/0001216 | A1 | 1/2006 | Strong et al. |
| 2006/0040745 | A1 | 2/2006 | Wells et al. |
| 2006/0058087 | A1 | 3/2006 | White et al. |
| 2006/0068899 | A1 | 3/2006 | White et al. |
| 2006/0121971 | A1* | 6/2006 | Slomiany et al. ..... 463/16 |
| 2006/0189381 | A1 | 8/2006 | Daniel et al. |
| 2006/0205508 | A1 | 9/2006 | Green |
| 2006/0270477 | A1 | 11/2006 | Snow |
| 2006/0281513 | A1 | 12/2006 | Kirkpatrick |
| 2006/0284376 | A1 | 12/2006 | Snow |
| 2006/0287103 | A1 | 12/2006 | Crawford, III et al. |
| 2007/0024005 | A1 | 2/2007 | Snow |
| 2007/0026935 | A1 | 2/2007 | Wolf et al. |
| 2007/0055753 | A1 | 3/2007 | Robb |
| 2007/0057462 | A1 | 3/2007 | Fleckenstein |
| 2007/0057469 | A1 | 3/2007 | Grauzer et al. |
| 2007/0072677 | A1 | 3/2007 | Lavoie et al. |
| 2007/0075494 | A1 | 4/2007 | Abbott |
| 2007/0111786 | A1 | 5/2007 | Snow |
| 2007/0184905 | A1 | 8/2007 | Gatto et al. |
| 2007/0197294 | A1 | 8/2007 | Gong |
| 2007/0197298 | A1 | 8/2007 | Rowe |
| 2007/0202941 | A1 | 8/2007 | Miltenberger et al. |
| 2007/0213116 | A1 | 9/2007 | Crawford et al. |
| 2007/0214058 | A1 | 9/2007 | Rouhi et al. |
| 2007/0225061 | A1 | 9/2007 | Naobayashi |
| 2007/0298854 | A1 | 12/2007 | Yoseloff et al. |
| 2008/0032763 | A1 | 2/2008 | Giobbi |
| 2008/0039192 | A1 | 2/2008 | Laut |
| 2008/0039208 | A1 | 2/2008 | Abrink et al. |
| 2008/0042355 | A1 | 2/2008 | Snow |
| 2008/0073840 | A1 | 3/2008 | Comeau |
| 2008/0096656 | A1 | 4/2008 | LeMay et al. |
| 2008/0108412 | A1 | 5/2008 | Snow et al. |
| 2008/0136102 | A1 | 6/2008 | Hoover |
| 2008/0176627 | A1 | 7/2008 | Lardie |
| 2008/0248875 | A1 | 10/2008 | Beatty |
| 2008/0252011 | A1 | 10/2008 | Bickley et al. |
| 2009/0100409 | A1 | 4/2009 | Toneguzzo |
| 2009/0121434 | A1 | 5/2009 | Baerlocher et al. |
| 2009/0121437 | A1 | 5/2009 | Snow et al. |
| 2009/0124385 | A1 | 5/2009 | Cuddy |
| 2009/0156310 | A1 | 6/2009 | Fargo |
| 2009/0298577 | A1 | 12/2009 | Gagner et al. |
| 2009/0302540 | A1 | 12/2009 | Snow et al. |
| 2009/0315264 | A1 | 12/2009 | Snow et al. |
| 2010/0016050 | A1 | 1/2010 | Snow et al. |
| 2010/0048304 | A1 | 2/2010 | Boesen |
| 2010/0069155 | A1 | 3/2010 | Schwartz et al. |
| 2010/0178987 | A1 | 7/2010 | Pacey |
| 2010/0197410 | A1 | 8/2010 | Leen et al. |
| 2010/0234110 | A1 | 9/2010 | Clarkson |
| 2010/0240440 | A1 | 9/2010 | Szrek et al. |
| 2010/0255899 | A1 | 10/2010 | Paulsen |
| 2011/0074107 | A1 | 3/2011 | Rowe |
| 2011/0105208 | A1 | 5/2011 | Bickley |
| 2011/0130190 | A1 | 6/2011 | Hamman et al. |
| 2011/0159952 | A1 | 6/2011 | Kerr |
| 2011/0159953 | A1 | 6/2011 | Kerr |
| 2011/0165936 | A1 | 7/2011 | Kerr |
| 2011/0172008 | A1 | 7/2011 | Alderucci |
| 2011/0175290 | A1* | 7/2011 | Huynh ..... 273/292 |
| 2011/0183748 | A1 | 7/2011 | Wilson et al. |
| 2011/0230268 | A1 | 9/2011 | Williams |
| 2011/0269529 | A1 | 11/2011 | Baerlocher |
| 2011/0275430 | A1 | 11/2011 | Walker et al. |
| 2011/0287829 | A1 | 11/2011 | Clarkson et al. |
| 2012/0015724 | A1 | 1/2012 | Ocko et al. |
| 2012/0015725 | A1 | 1/2012 | Ocko et al. |
| 2012/0015743 | A1 | 1/2012 | Lam et al. |
| 2012/0015747 | A1 | 1/2012 | Ocko et al. |
| 2012/0021835 | A1 | 1/2012 | Keller et al. |
| 2012/0034977 | A1 | 2/2012 | Kammler |
| 2012/0214567 | A1 | 8/2012 | Snow |
| 2012/0280454 | A1 | 11/2012 | Snow |
| 2012/0295691 | A1 | 11/2012 | Walker |
| 2013/0023319 | A1 | 1/2013 | Snow |
| 2013/0053117 | A1 | 2/2013 | Snow |
| 2013/0184059 | A1 | 7/2013 | Costello et al. |
| 2013/0184060 | A1 | 7/2013 | Costello et al. |
| 2013/0184079 | A1 | 7/2013 | Costello et al. |
| 2013/0274003 | A1 | 10/2013 | Costello |
| 2013/0296024 | A1 | 11/2013 | Castle, II |
| 2013/0296025 | A1 | 11/2013 | Castle, II et al. |

FOREIGN PATENT DOCUMENTS

| | | | |
|---|---|---|---|
| AU | 2012201809 | A1 | 4/2012 |
| CA | 2 529 076 | A1 | 6/2006 |
| GB | 667345 | A | 2/1952 |
| GB | 9414822 | | 7/1994 |
| GB | 9426324 | | 12/1994 |
| WO | WO 2007/047223 | A2 | 4/2007 |
| WO | WO 2008/061001 | A2 | 5/2008 |
| WO | WO 2009/061618 | A1 | 5/2009 |
| WO | WO 2011/109454 | A1 | 9/2011 |

OTHER PUBLICATIONS

"WPT World Poker Tour ALL-IN-HOLD'EM," Lakes Entertainment, Inc., http://www.lakesentertainment.com/games/wpt/, (2005), 6 pages.

"Card Craps," Scarne's Encyclopedia of Card Games, (1948), pp. 321-323.

"Flop-A-Lock," Flop-A-Lock, Inc., (2006), 1 page.

"Mikohn Launches Texas Hold 'Em Bonus Poker Table Game," http://www.findarticles.com/p/articles/mi_m0EIN/is_2004_July_26/ai_n6122536/print, (Jul. 26, 2004), 1 page.

"Poker Rules & Poker Questions Answered," http://www.oldvegaschips.com/pokerules.htm (accessed Mar. 10, 2006), 42 pages.

"Table Games—Texas Hold 'EM Bonus Poker," Progressive Gaming Int'l Corp., http://www.virtgame.com/pages/games/texasholdem.html, (2005), 2 pages.

"Texas Shootout," http://www.galaxygaming.com/texas-shootouthtml, http://www.galaxygaming.com/images/TS-Odds.jpg,

(56) References Cited

OTHER PUBLICATIONS http://www.galaxygaming.com/images/TS-Sign.jpg, http://www.galaxygaming.com/images/TS-Crd.jpg, (2005), 5 pages.
Australian Examination Report for AU Patent App. No. 2012201809, dated Oct. 10, 2013, 5 pages.
Australian Examination Report for AU Patent App. No. 2006202691, dated Sep. 23, 2010, 2 pages.
Australian Examination Report for AU Patent App. No. 2006202691, dated Feb. 20, 2012, 2 pages.
"Card Games from the Good Gambling Guide—3 Card Brag," http://www.thegoodgamblingguide.co.uk/games/cardgames.htm, (archived Aug. 2013), 6 pages.
Copyright filing with the Bureau voor de Intellectuele Eigendom, Aruba, (Jan. 13, 1998), 13 pages.
Gibson, Walter B., "Hoyle's Modern Encyclopedia of Card Games," (1993 ed.), pp. 252, 257, & 258.
Gibson, Walter B., "Hoyle's Modern Encyclopedia of Card Games," (1993 ed.), p. 250.
Marchel, John, "KISS Guide to Gambling," DK Publishing, Inc., Glossary: No-Limit, (2001), p. 344.
New Jersey Register (vol. 30, No. 14, Jul. 20, 1998). Rule Adoption, Other Agencies, Casino Control Commission, Accounting and Controls, Gaming Equipment, Rules of the Games, Fast Action Hold'Em (Westlaw 30 N.J.R. 2639 (b)), (2005 Thomson/West), pp. 1-15.
"Table Games—Texas Hold 'Em Bonus TM Poker," Progressive Gaming, http://www.progressivegaming.net/pages/games/texasholdem.html, (archived Aug. 2005), 2 pages.
Scarne, John, "Encyclopedia of Games," "Show Five Cards," Harper & Row Publishers, Inc., (1973), pp. 28-29.
Scarne, John, "Scarne's Guide to Modern Poker," "Brag," Constable and Company Limited, (1980), pp. 159-160.
Sklansky, David, Published rule sheet for "CASINO POKER," VEGAS WORLD, (1982), 1 page.
Webb, Derek, J., "Prime Table Games—Disclosure in Respect of Three Card Games," (by Feb. 10, 1999), 1 page.
United States Office Action, U.S. Appl. No. 13/631,816, filed Feb. 27, 2014, 15 pages.
United States Office Action, U.S. Appl. No. 13/624,743, filed Jan. 29, 2013, 7 pages.
U.S. Appl. No. 13/860,991, filed Apr. 11, 2013, Inventors Andrew Costello et al.
U.S. Appl. No. 13/353,194, filed Jan. 18, 2012, Inventors Andrew Costello et al.
U.S. Appl. No. 13/609,031, filed Sep. 10, 2012, Inventors Andrew Costello et al.
U.S. Appl. No. 13/624,743, filed Sep. 21, 2012, Inventors Andrew Costello et al.
U.S. Appl. No. 13/864,069, filed Apr. 16, 2013, Inventors Louis J. Castle et al.
U.S. Appl. No. 13/871,824, filed Apr. 26, 2013, Inventors Louis J. Castle et al.
International Search Report of the International Searching Authority for PCT/US13/22153, dated Apr. 8, 2013, 2 pages.
International Search Report and Written Opinion of the International Searching Authority for PCT/US13/21959, dated May 10, 2013, 7 pages.
International Search Report of the International Searching Authority for PCT/US2013/038688, dated Oct. 10, 2013, 4 pages.
United States Office Action, U.S. Appl. No. 13/631,821, filed Oct. 29, 2013, 7 pages.
United States Office Action, U.S. Appl. No. 13/631,818, filed Oct. 29, 2013, 8 pages.
"No Fold'em Hold'em," ACM, Greater New York Programming Contest 2005, http://www.acmgnyr.org/year2005/g.pdf, (2005), 2 pages.

* cited by examiner

VARIANT OF TEXAS HOLD 'EM POKER

CROSS-REFERENCE TO RELATED APPLICATIONS

This application is a continuation-in-part of U.S. patent application Ser. No. 13/631,816, filed Sep. 28, 2012, pending, which is a continuation-in-part of U.S. patent application Ser. No. 13/455,742, filed Apr. 25, 2012, pending, which is a divisional of U.S. patent application Ser. No. 11/156,352, filed Jun. 17, 2005, now abandoned, the disclosure of each of which is hereby incorporated herein, in its entirety, by this reference.

TECHNICAL FIELD

This disclosure relates to wagering games, casino table wagering games, casino table playing card wagering games, computer-implemented wagering games, and variants of casino table wagering games that use poker ranks in determining outcomes.

BACKGROUND

Many different wagering games presently exist for use in both home and casino environments. Such games should necessarily be exciting, uncomplicated, and easy to learn to avoid frustrating players. Designing new games that meet these criteria and are sufficiently different from old games to entice players to play the new game is a particular challenge.

BRIEF SUMMARY

A variant game of Hold 'Em poker allows for rules of play wherein one player or all players are allowed to remain in the game with an option of checking or making specific wagering amounts in first play wagers. For purposes of this disclosure, "checking" means staying in the game without making an additional wager. Games disclosed herein have limits and prohibitions regarding the size of the bets that can be made as the game progresses. Play wagers, if made earlier in the game, can be multiples of later-made play wagers. For example, players may be given the opportunity for making play wagers during at least two different stages of play and may have the opportunity to make a play wager in as many as three or four distinct stages in the play of a single hand. As the game progresses, more information is available to the player, and, consequently, the permitted amounts of wagers decrease with increasing information.

The games described in this disclosure can offer side bets that are based on an entire Hold 'Em hand because players may check or make play wagers and, in embodiments, do not fold. When there is no folding of hands, an entire game hand can be considered in resolving side bets.

One embodiment of the game is based upon a five-card hand that uses poker-style rankings. In this game, the player is dealt or otherwise receives less than a full hand, and, using one or more community cards, makes the best possible five-card hand he or she can. Providing more than one community card may provide additional betting opportunities as the community cards are revealed. The game, in one embodiment, is based on five-card poker hand rankings, and, in other embodiments, other poker hand ranking systems are used, such as three-card poker rankings, four-card poker rankings, and seven-card poker rankings.

Further embodiments may include one, some, or all of the following: The acts of the dealer may be carried out by a visual representation of a dealer, the visual representation being generated and/or displayed by a computer. The visual representation may be a virtual person (e.g., an animation) or may be a transmission (e.g., a video) of an actual person. The visual representation may be part of an online gaming experience of the disclosed game. The acts described in this disclosure as being associated with a dealer, including dealing cards, displaying or turning cards over, receiving or paying bets, or any other actions, may be represented in any way when used in an online environment. For example, the cards associated with a dealer action, described as being dealt or otherwise handled by a dealer, may appear as virtual cards or as transmitted pictures of physical cards. This may include a display of virtual card decks where each deck, individual card, and hand is displayed to an online player in a manner consistent with the game play disclosed herein, but may or may not include a visual representation of a dealer with the cards. Likewise, betting activity may be displayed in any manner to a player, including, but not limited to, virtual chips, betting pools, numbers, or other indicia of a bet amount.

The online experience may involve players playing remotely (e.g., in a different physical location) from the dealer, the location of a game server, or both, interacting through a networked connection that may include, but is not limited to, the Internet. The online game play may involve players who are also physically remote from each other. Remote connections may use networks involving several types of network links including, but not limited to, the Internet. Networked connections allowing physically remote players to play a game using a game server or system may be part of an implementation of a virtual or online gaming environment.

The actions described in this disclosure as the acts of a player, including betting, card selection (if any), card discards (if any), or any other actions, may be carried out over a network where the indicated actions are received as input to a device. The input-receiving device is typically physically remote from the game server or game host and connected over a long-distance network, but may also be implemented over a wired or wireless LAN in one building, or even in one room, for example. In one embodiment, game play generated at the server or host location may be displayed on the same device as the receiving device. In some embodiments, game play may be conveyed to remote players in devices separate from the devices receiving input from a player, such as public screens or publicly broadcast data about a game coupled with individual or private input devices. The reception of an input at a device may be accomplished through any technology adapted for such a purpose including, but not limited to, keypads, keyboards, touchpads, mice, optical location devices, eye movement/location detectors, sound input devices, etc. When discussing a device, it is understood the device may comprise multiple components and be complex, including hardware components combined with firmware and/or software, and may itself be a subcomponent of a larger system.

Yet other embodiments may comprise apparatuses and systems for administering wagering games according to embodiments of the disclosure.

BRIEF DESCRIPTION OF THE DRAWINGS

While the disclosure concludes with claims particularly pointing out and distinctly claiming embodiments within the scope of the disclosure, various features and advantages of embodiments encompassed by the disclosure may be more readily ascertained from the following description when read in conjunction with the accompanying drawings, in which:

DETAILED DESCRIPTION

The illustrations presented herein are not meant to be actual views of any particular act in a method of administering a wagering game, apparatus for use in administering a wagering game, or component thereof, but are merely idealized representations employed to describe illustrative embodiments. Thus, the drawings are not necessarily to scale. Additionally, elements common between figures may retain the same or similar numerical designation. Elements with the same number, but including a different alphabet character as a suffix should be considered as multiple instantiations of substantially similar elements and may be referred to generically without an alphabet character suffix. For example, elements 100*a*, 100*b*, and 100*c* may be a device that is instantiated three times and referred to generically as element 100.

The terms "gaming," "gambling," or the like, refer to activities, games, sessions, rounds, hands, rolls, operations, and other events related to wagering games, such as web-based games, casino games, card games, dice games, and other games, the outcome of which is at least partially based on one or more random events ("a game of chance") and on which wagers may be placed by a player. In addition, the words "wager," "bet," "bid," or the like refer to any type of wagers, bets, or gaming ventures that are placed on random events, whether of monetary or non-monetary value. Points, credits, and other items of value may be purchased, earned, or otherwise issued prior to beginning the wagering game. In some embodiments, purchased points, credits, or other items of value may have an exchange rate that is not one-to-one to the currency used by the user. For example, a wager may include money, points, credits, symbols, or other items that may have some value related to a wagering game. Wagers may be placed in wagering games that are "play for pay" as well as "play for fun," as will be described in more detail below.

Figure 1:
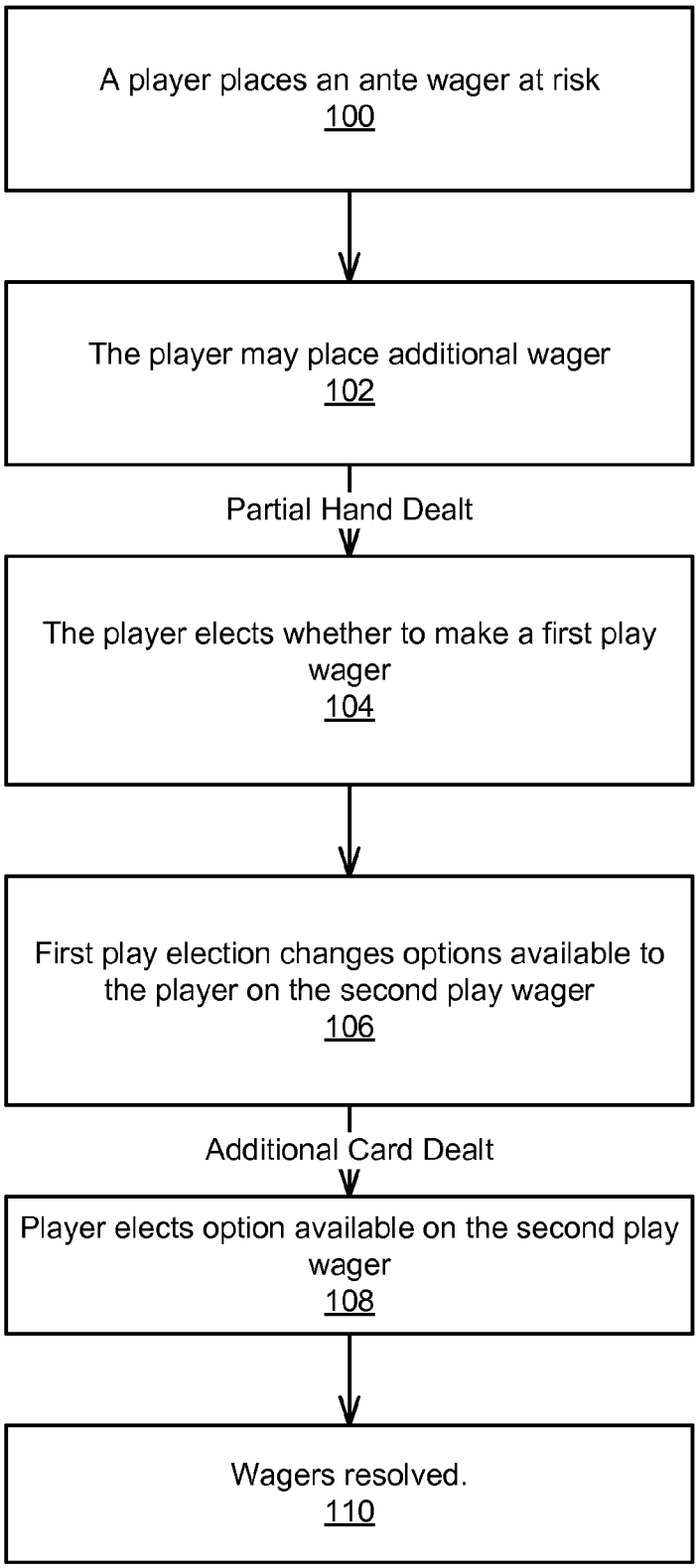
FIG. 1 is a flowchart diagram of a method of administering a wagering game.

Referring to FIG. 1, a flowchart diagram of one embodiment of a method of administering a wagering game is shown from a player's perspective. Although many of the operations are described in this manner, it is to be understood that the dealer or a processor administers the game, and the administrator and/or the processor may receive instructions to execute steps in response to receiving player elections. A player initially places at least an ante wager (operation 100) that places an ante wager value at risk prior to dealing any cards. The dealer or the processor receives an indication that a player ante wager has been received. The dealer may deal a partial hand of cards to each player before, during, or after the ante wager is received at operation 100. The player is also provided with an opportunity to make at least one additional wager (operation 102), such as a blind wager, a bonus wager, multiple bonus wagers, and combinations thereof, that places additional value at risk. The blind wager may be a mandatory wager in some embodiments. A partial hand of cards, including at least a first card, is dealt to the player. In some embodiments, two player cards are dealt to each player. The dealer permits the player to view the player's hand, and then the dealer accepts a first player election to make a first play wager (operation 104). The player may elect (at operation 104) to make a first play wager after seeing the partial hand. When the dealer accepts a first play wager election from the player, the receipt of the first play wager changes the player's election options (in operation 106) available to the player on a game play election event. For example, after the dealer receives a first game play election from the player to make a first play wager, the player may be prohibited from making additional play wagers. Instead, the player may be required to check at the second game play election event. If the player does not elect to make the first play wager, the player may be permitted to make a second play wager. Thus, based on the first play wager election decision, options for the second play wager change. At least one additional card is dealt between the first and second game play election option events. The player makes a second game play election (operation 108) based on the options available to the player. Any remaining cards are dealt, and the wagers are then resolved (operation 110). In other embodiments, more than two game play election options are made available to the player.

In one embodiment of a method of administering a wagering game, the player is permitted to place, and the dealer receives, only one play wager election per player in a round of play. In this embodiment, if a player has previously elected to play a play wager, the player is required to check (or fold) at the remaining game play election events. Additional features of these embodiments and further embodiments of a wagering game are described below.

A basic format (whether on a table or automated device, with computer, processor, monitor, cash/credit/token receptors, etc.) of play involves a player making at least a first ante wager to enter the game against a dealer's hand. The dealer and players each receive at least one card. In one example of the game, the dealer provides two cards to each player who made an ante wager and provides two cards to the dealer. The player cards may be face up or face down. Providing the player cards face down may be preferable to the players and also preferable to the house. Typically, the dealer and players each receive the same number of cards, though a game can include dealing unequal numbers of cards to the dealer and players, which will alter the house advantage. For example, giving the dealer three cards instead of two cards and allowing the dealer to discard one card would provide a greater advantage to the house.

One example of the game play described herein is referred to as the "ULTIMATE TEXAS HOLD 'EM"® game, formerly owned and distributed by SHFL entertainment, Inc., of Las Vegas, Nev., now distributed by Bally Technologies, Inc., of Las Vegas, Nev. To begin the game, players make at least one ante wager, or preferably at least two initial equal wagers, such as an ante wager and a blind wager. The ante wager is mandatory to participate in this embodiment of the game. In one form of the game, the blind wager is also mandatory. A bonus wager (called the "trips" wager) is optional and is based on the player's resulting five-card hand, from a best five-card hand out of seven cards, having an ultimate hand rank of at least a three-of-a-kind Players and the dealer make a best five-card poker hand from two dealt cards and five community cards. Other higher-ranking hands also pay bonus payouts according to a pay table listing winning hand outcomes and corresponding payout odds. The minimum hand of three-of-a-kind is selected, in this embodiment, based on the mathematics of the game and a pay table and is a matter of design choice. In this example of the game, the dealer deals each player two hole cards face down. The dealer receives a two-card dealer hand of two hole cards (face down). This two-card hand may be dealt at the same approximate time as the player hand or nearer the end of the game, after all wagers have been placed and the player has seen all available cards. Similarly, the five community cards can be dealt when the player cards are dealt or when the game rules call for revealing community cards. In one embodiment, the community cards are dealt face-down at the beginning of the game, before, during, or after the ante and blind wagers are received and before the first game play election event is administered.

In one embodiment, after viewing the hole cards, players may make a game play election, which may include making a single play wager that may be made at different predetermined stages in the progression of the hand. Furthermore, an amount of the play wager may vary with the stage of progression of the hand of the game. In one example, the player can make the play wager only once and can make the play wager at up to three or four different stages in the progress of the game. With each passing step, the amount of the permitted wager decreases. The player is, therefore, rewarded for risking larger amounts earlier in the game, when less information about the outcome of the hand is available for the player. As the player learns additional information about whether the player is likely to win the wager, the player is able to wager less money on the play wager. In some embodiments, the player also receives partial information about the dealer hand as the game progresses. For example, when community cards are revealed that are usable by the dealer to make his best hand, the player is also gaining valuable information about the strength of the player hand vs. the dealer hand.

The game rules also set limits on the amount of each possible play wager. For example, in the early stages of a round, the play wager can be chosen from within a range, such as 1× and 10×, 1× to 6×, or 1× to 4× the ante wager, for example. At the last stage, the play wager may be limited to no more than 1× the ante wager. Depending upon the stage of the game when the play wager is made, with earlier stages allowing larger play wagers and later stages allowing for relatively smaller play wagers, higher payouts can be made to a player who puts more at risk when less information is available.

In this example, after seeing their two hole cards, players have a specific choice; check (remaining in the game) or making a specific play wager amount (e.g., precisely a 4× wager). In other examples, rather than a specific play wager amount, the player may choose a bet within a range of wagers (e.g., between 1× and 10×). The "×" indicates a multiple of the ante wager. In one embodiment, players may not fold until after all player cards are distributed and/or revealed, including any community cards. In embodiments, the player is allowed to see additional card(s) that may well improve an apparently weak hand and decide at that time to place a play wager. When no folding is permitted until after all player-usable cards are revealed, the range of payouts on the side bets can be increased because it becomes possible to use and consider a complete hand of player cards in determining winning outcomes.

After the dealer receives the first player game play election, the dealer then displays (deals or reveals) the first set of community cards. In one embodiment, the first set is three community cards out of a total of five final community cards. The first election options, in examples of the invention, are a check or a play wager equal to 3× to 4× the size of the ante wager, at the option of the player. In other embodiments, more or fewer than five cards are dealt as community cards, and the initial display of community cards may also be adjusted.

In one example of the game, before any community cards are revealed, the players know only two out of seven cards (i.e., the player's initial hand) the player may use to form a hand. After the initial set of three community cards is revealed, players know the identity of five out of the seven cards. When the fourth community card is revealed, players know six out of the seven cards, and when the last community card is turned over, they know all seven and can pick the best five cards. The first three cards in Hold 'Em games is typically referred to as the "flop." The fourth card is referred to as the "turn card" or simply "the turn," and the fifth community card is referred to as the "river card" or simply "the river." In some embodiments, the turn card and the river card are revealed in a single step.

After seeing the first set of community cards, the players have the following options. If they have not already made the first wager (e.g., the specific amount wager, such as the 4× play wager), they may again check (remaining in the game without wagering at this time) or make a second play wager of an amount less than the amount of the first play wager, such as a 2× or 3× the ante wager for the second play wager. If the player made the original, first play wager, e.g., the 4× play wager, the player may not make an additional play wager and must check for the remainder of the game. In this example of the game, players cannot fold. In some embodiments, additional play wagers may be made in smaller amounts by the player who made an original play wager. Typically, no action, other than a check, can be made by the player who made the original play (4×) wager at this point; although, in other examples of the game, folding or a surrender can also be allowed.

Players may also have a choice to play a range of play wagers, such as from 1× to 4× the ante wager in the original play wager, and 1× to 3× the ante wager in the second play wager, etc.

The dealer then displays additional community cards, up to the total number of community cards, depending on the embodiment, such as both of the remaining community cards (the turn and the river). Another embodiment would allow an additional wager with the fourth but not the fifth community card revealed where the player has not previously made a play wager. An example of such a wager could be 2× or 3× the ante wager or a range of 1× to up to 3× the ante wager. In one embodiment, play wagers are allowed after the first two player cards are revealed, after the flop is revealed, after the fourth card is revealed, and after the fifth community card is revealed, for a total of four play bet opportunities. In other embodiments, the fourth and fifth community cards are simultaneously revealed, and a total of three play wager opportunities are provided.

The player now knows all seven of the cards from which he or she may make his or her best five-card hand. If the player has made no play wagers in the previous steps, the player may have an additional opportunity, knowing the final composition of the player hand, to make a play wager (in one embodiment, 1× of the ante wager) or fold. If the player has made a previous play wager, the player may check. In one embodiment, a player who has previously made a play wager may also fold or may be allowed to surrender a portion of the player's bet.

The dealer then reveals his two hole cards to determine the dealer's best five-card hand using the dealer's hole cards and the community cards. In one example, players are free to use any five of the seven available cards to form a player's hand. Players may, alternatively, be required to use their hole cards, or the three highest-ranking community cards, or four community cards and one player hole card. Many other minor rule variations for generating a five-card hand may be implemented without departing from the scope of this disclosure.

The dealer's best five-of-seven-cards hand is compared against each player's best five-of-seven-cards hand to determine head-to-head winners. In one embodiment, no dealer or player qualifying step is necessary to play the game. In an alternative embodiment, the dealer and/or the players must qualify with a predetermined minimum card ranking in order to play. If the dealer, for example, does not qualify with a pair or better, for example, the ante wagers are returned to the players. However, the play wagers, blind wagers, and any side wagers are resolved in the normal manner. Play wagers are also resolved in the normal manner. All winning payouts on side wagers are still paid, regardless of whether the dealer qualifies. All automatic bonus payouts are also made. When there is no dealer or player qualification step, then the dealer hand is compared to player hands, and the highest-ranking hand wins the round. Ante wagers are paid even money. Blind wagers are paid odds for certain high-ranking hands, and side wagers are paid odds according to a pay table.

The player also wins 1:1 on the play wagers when his or her hand beats the dealer's hand, and ties are pushes. The player loses the ante wager and all play wagers when the player's hand has a lower rank than the dealer's hand.

The blind wager is typically equal to the ante wager, but, in other embodiments, can be multiples of the ante wager. The blind wager may be mandatory. The blind wager wins when the player has a predetermined winning hand rank, for example, a flush or higher, and the player's hand beats the dealer's hand. The blind wager loses when the player's hand loses. The blind wager pushes when the player's hand ties the dealer's hand. The blind wager also pushes when the player's hand is less than a flush but beats the dealer's hand.

The "trips" wager, in one embodiment, is an optional side wager. In other embodiments, an optional progressive side wager can also be offered.

Distinct pay tables may be provided for the blind and trips wagers, such as:

| Blind payouts | |
|---|---|
| Royal flush | 200:1 |
| Straight flush | 50:1 |
| Four-of-a-kind | 10:1 |
| Full house | 2:1 |
| Flush | 3:2 |
| **Trips payouts** | |
| Royal flush | 50:1 |
| Straight flush | 40:1 |
| Four-of-a-kind | 30:1 |
| Full house | 8:1 |
| Flush | 7:1 |
| Straight | 4:1 |
| Three-of-a-kind | 3:1 |

The following example of a hand of play of the ULTIMATE TEXAS HOLD 'EM® poker embodiment is provided below. In ULTIMATE TEXAS HOLD 'EM®, players place at least an ante wager and a blind wager of equal value, as well as an optional trips wager on betting circles on a gaming table surface. Two cards are initially dealt to each player as well as to the dealer. Five community cards are used, which are revealed in two steps. The first step reveals the first three community cards, and the second step reveals the last two community cards. Until all of the community cards are revealed, players may check (place no bets) or may place a play wager. The players in ULTIMATE TEXAS HOLD 'EM® may place only a single play wager during the course of the game. As cards are revealed, the amount allowed for the play wager decreases. Prior to revealing any community cards, the players in ULTIMATE TEXAS HOLD 'EM® may make a play wager of either 4× or 3× the ante wager or the player may check. After the first three community cards are revealed, players may make a play wager of exactly 2× the ante wager or the player may check. If the player previously made a 4× or 3× play wager, the player must check. When the remaining two community cards are revealed, players who have not previously made a play wager may make a play wager of exactly 1× the ante wager or the player may fold. If the player has placed a play wager, the player's poker hand is determined by making the best five-card poker hand among the player's two cards and the five community cards. The dealer's poker hand is determined by making the best five-card poker hand among the dealer's two cards and the same five community cards. Wagers are resolved based on the player's and the dealer's five-card poker hands and, for the blind and trips wagers, based on a pay table for qualifying hands. An example follows:

| Dealer Activity | Player 1 Activity | Player 2 Activity |
|---|---|---|
| Awaits wagers | $5 ante, $5 blind | $10 ante, $10 blind, $5 trips |

The dealer's partial hand of two cards is dealt face down to the dealer, and each of Player 1 and Player 2 receives his or her partial hand of two cards. The cards may be face down, face up, or partially exposed for the players.

| Dealer Activity | Player 1 Activity | Player 2 Activity |
|---|---|---|
| Cards Hidden | 10♣ Jack♣ | King♥ King♦ |

After viewing their initial, partial, two-card hands, the players may make their decisions on the first play wager. Player 1's hole cards are good, but do not warrant a large wager. If given a choice between a check up to the extreme of 4× the ante wager, Player 1 would elect to check. He chooses to check because he does not have enough information to determine whether his hand is strong enough to win. Player 2's hand is very good, although it still has not reached a bonus level payout (e.g., a three-of-a-kind or better, or at least a straight), but the hand probably warrants the maximum first play wager of 4× the ante wager or an additional $40.00 wagered. In this embodiment, Player 2 may not make any further wagers and checks until the completion of the round.

After conclusion of this first play wager round of wagering, the flop (three community cards) is shown. Those cards in this Example are:

King♣, Queen♦, and 7♠.

These cards provide Player 1 with an outside (two-way) straight draw and two running cards for a club flush, with two cards remaining to be drawn. This hand is considered a relatively good hand. Player 1, who has not yet made a play wager, might, therefore, elect to make the maximum second play wager of 2× the ante wager, or $10.00. As noted earlier, in this embodiment Player 2 has no further wagers available, but would be happy with the flop, providing a rank of a three-of-a-kind at this stage.

| Dealer Activity | Player 1 Activity | Player 2 Activity |
|---|---|---|
| Cards Hidden | $10 2× second play opportunity | $40, 4× first play opportunity |

At this point, in the example method of play, the last two community cards are revealed. In this example, the community cards are:

7♦ and 4♥.

At this point, the rank of Player 1's hand is a pair of sevens, and the rank of Player 2's hand is a full house.

As both players have made play wagers at this time, if the rules limit player activity to a single play wager during the progress of a hand, no further play wagers may be made. If Player 1 had been conservative in the second play wager stage and checked, then Player 1 might be required to make a third play wager of 1× to remain in the game, may be allowed to check, or may be allowed to fold at this stage. Having made the earlier second play wager, Player 1 would have no choice but to check at this point. If allowed, Player 2 might make an additional wager.

At this point, the dealer would reveal the two cards in the dealer's partial hand. Although it is common for the dealer's two-card partial hand to have been dealt at the same time as the players' partial hands and to have been kept face down, as a security measure (preventing any possibility of those dealer cards having been exposed or partially exposed) the dealer's two cards might be dealt at the end of play, at this point in the play of the hand of the game.

The dealer's cards are 10♥ and Jack♦. This dealer's hand is, in combination with the community cards, identical with the rank of Player 1's hand, so the ante wager is a push according to the rules of play. The blind wager loses.

Player 2's hand rank, as a full house, wins 1:1 on the ante wager ($10), wins 1:1 on the 4× first play wager ($40), wins 2:1 ($20) on the blind wager, and wins 8:1 ($40) on the trips wager for a total win of $110.

Various platforms are contemplated that are suitable for implementation of embodiments of wagering games according to the present disclosure. For example, embodiments of wagering games may be implemented such that one or more players may place wagers and engage in game play according to the rules of the wagering games. For example, wagering games may be implemented on gaming tables, which may include physical gaming features, such as physical cards, physical chips, and may include a live dealer and a shuffler or shoe. More specifically, a live dealer may deal physical cards, accept wagers, receive game play elections, issue payouts, and perform other administrative functions of game play. Some embodiments may be implemented on electronic devices enabling electronic gaming features, such as providing electronic displays for display of virtual cards, virtual chips, game instructions, pay tables, etc. Some embodiments may include features that are a combination of physical and electronic features.

As an example, embodiments of wagering games may be implemented on an individual gaming device for accepting wagers that has a display screen and input devices for enabling game play of the wagering games. Such an individual gaming device may be linked with other gaming devices that may be operated, for example, by other players. Some individual electronic gaming devices may be referred to as individual player "cabinets" and may be stationary, such as being located on a casino floor. Other individual electronic gaming devices may be portable devices that may be carried to different locations by the players. A portable device may include both display of the ongoing game play and input reception for game play by a player, and it may be configured for receiving input from a player while the game play is displayed on a public monitor, or other display device. Game play and game outcomes may also be displayed on a portable device.

As previously noted, the present games and rules may be played as live casino table card games, as hybrid casino table card games (with virtual cards or virtual chips), on a multiplayer electronic platform (as disclosed in U.S. patent application Ser. No. 10/764,827 (published as U.S. Patent Application Publication No. 2005/0164759 A1 on Jul. 28, 2005) (now abandoned); Ser. No. 10/764,994 (now U.S. Pat. No. 7,661,676, issued Feb. 16, 2010); and Ser. No. 10/764,995 (now U.S. Pat. No. 8,272,958, issued Sep. 25, 2012), all filed on Jan. 26, 2004, the disclosure of each of which applications is hereby incorporated herein in its entirety by this reference), on a personal computer for practice, on a hand-held game for practice, or on a legally authorized site on the Internet.

In one embodiment, the players are remotely located from a live dealer, and the players observe a live dealer and a game table on their monitors via a video feed. The players' video feeds may be transmitted to the dealer and, also, may be shared among the players at the table. In a sample embodiment, a central station includes a plurality of betting-type game devices and an electronic camera for each game device. A plurality of player stations may be remotely located with respect to the central stations, each one of the player stations including a monitor, for displaying a selected game device at the central station, and input means, for selecting a game device and for placing a bet by a player at the player's station relating to an action involving an element of chance to occur at the selected game device. Further details on gambling systems and methods for remotely located players are disclosed in U.S. Pat. No. 6,755,741 B1, issued Jun. 29, 2004, titled "Gambling Game System and Method for Remotely-Located Players," the disclosure of which is incorporated herein in its entirety by this reference, and in connection with FIGS. 8 and 9.

Figure 2:
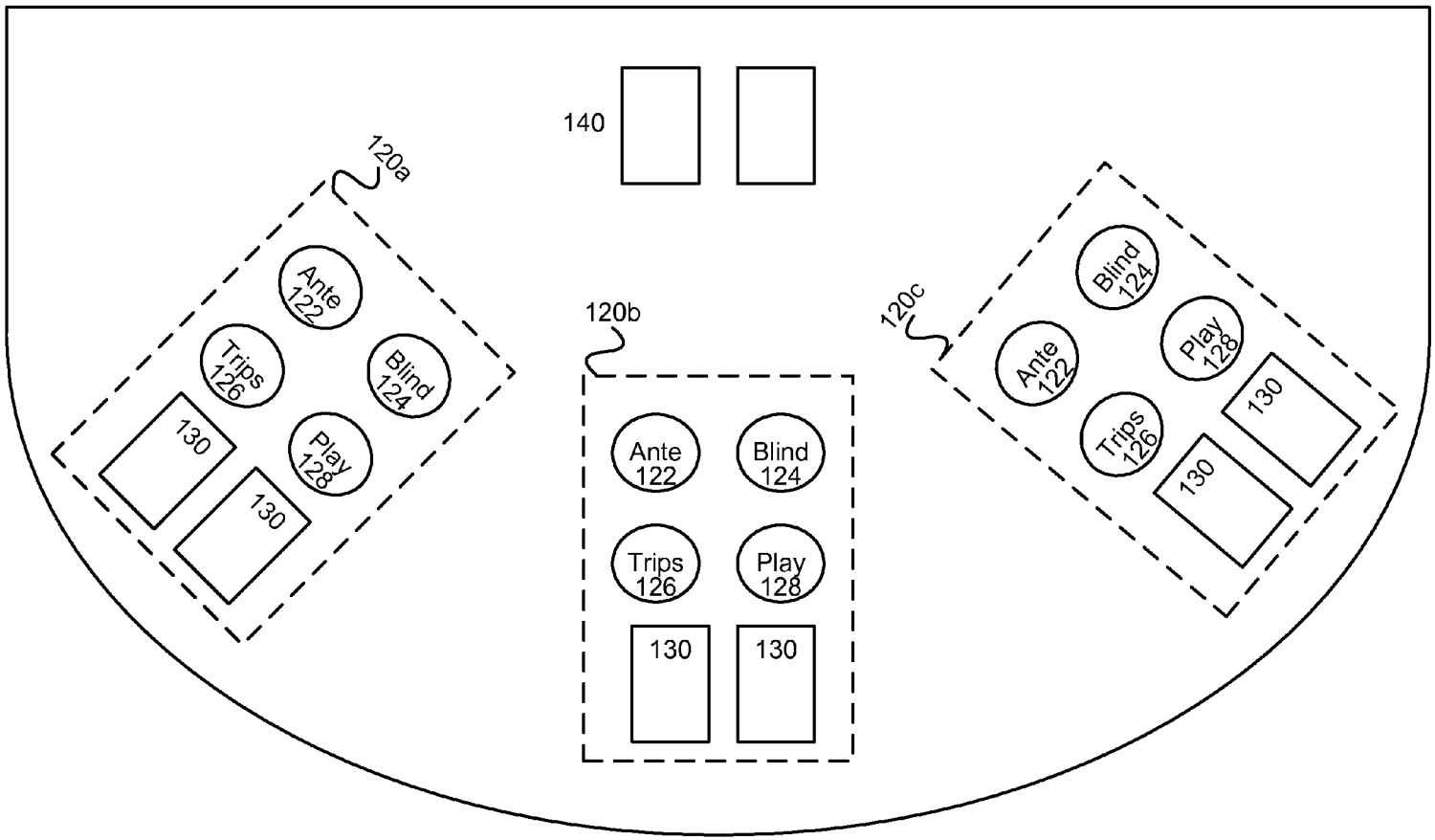
FIG. 2 is a diagram of a playing surface for implementation of the wagering game.

Referring to FIG. 2, shown is a diagram of a playing surface for implementation of the wagering games within the scope of the present disclosure. This betting layout corresponds to the ULTIMATE TEXAS HOLD 'EM® embodiment. A dealer's hand 140 of two cards is shown, and players' hands 130 of two cards each for three players are also shown. Each player's position 120 is provided with four separate betting areas for the ante wager 122, the blind wager 124, the trips wager 126, and the elected play wager 128. Each player position 120 may not be explicitly labeled on the betting layout. As there may be only a single play wager made during the play of the game, in these embodiments, a single play wager betting area 128 is provided. The presence or absence of a token or coin in that area 128 at any time may indicate the status and opportunity of players to make play wagers and the amount of play wagers at the various stages of the games. For example, when the flop has been exposed, if there is no bet present in area 128, then the lack of a play wager indicates that a) the player can still make a play wager, and b) that the player is known to have specific ranges or amounts of the second play wager available to that player. In contrast, if a bet is present, then the player is known to have no second play wager available at that stage of the game.

Figure 3:
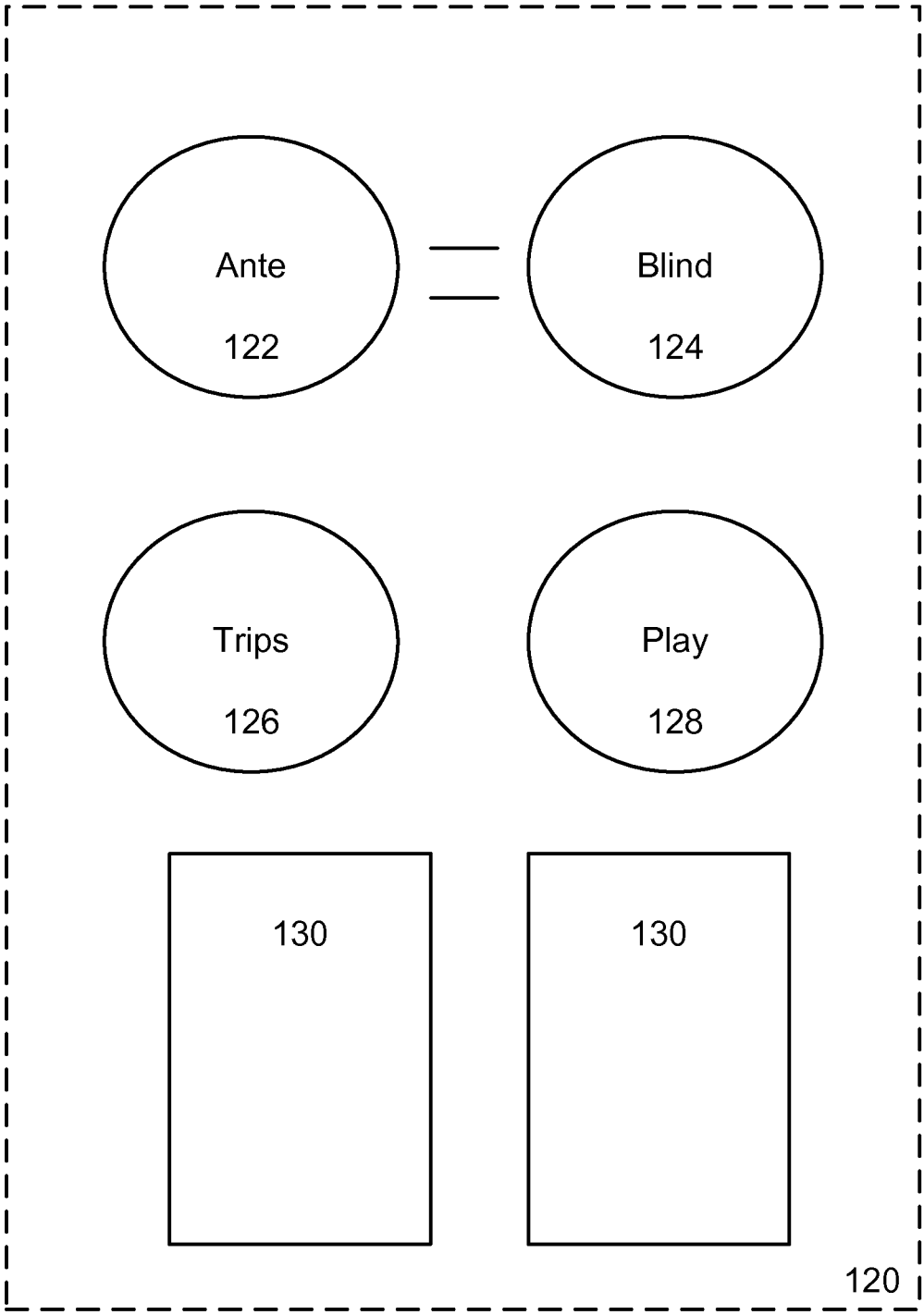
FIG. 3 is an enlarged diagram of one of the player positions of the playing surface of FIG. 2.

Referring to FIG. 3, an enlarged diagram of one of the player positions 120 of the playing surface of FIG. 2 is shown. As shown in FIG. 3, the player positions 120 may also include an indication, in one embodiment, that the blind wager must equal the ante wager amount. As described above, the player position 120 includes a position for the player hand 130 and an indication of the ante wager 122, the blind wager 124, the trips wager 126, and a play wager 128.

Additional betting areas may be used if additional wagers are allowed. For example, the game rules might allow four different opportunities to make a play wager and provide a different betting circle (and betting limits) for each stage of the game. For example, if a player has placed the 4× first play wager, the rules of the game may be modified to allow for additional wagers at the same or at lower odds than the earlier play wagers. If the rules of the game allow for multiple play wagers, it would be desirable to provide multiple betting circles on the layout. For example, if Player 2, in the example described above, had received a flop of a king and a pair, or two additional kings, he might be allowed to make an additional wager in one embodiment. The rules of the game might allow for one additional play wager at the same 1:1 odds or allow subsequent wagers to be placed at lower odds, such as 1:2 odds, returning an additional 50% on the second play wager.

Other embodiments are also contemplated. For example, a four-card version of the game could be offered in which each player and the dealer receive one card, and the dealer deals three or four community cards. Players can bet up to 3× the ante wager after viewing the first card, up to 2× the ante wager after seeing the first two community cards, and up to 1× the ante wager after seeing all of the cards.

An interesting aspect is that, in a form of play as described above, players either check or raise during various stages of play of a Hold 'Em style poker game, but the players are not permitted to fold until the end. This rule enables play of a side wager based on the composition of the entire final hand of cards. In typical Hold 'Em games, players fold before all of the cards are revealed, making it impossible to base side wager results on a five-card hand, for example. Five-card outcomes have a wider variety of probabilities and allow for game designs offering higher payouts for less frequently occurring hands, such as obtaining a five-card royal flush, for example.

Another feature of this embodiment is that players are permitted to place wagers on a hand after all of the community cards are revealed. This feature allows a player to know the player's five-card hand prior to placing a final bet and may have appeal to a player who prefers certainty about the player's hand strength before making a bet.

In some embodiments, the wagering games described herein may be played against the house (i.e., be "house-banked"), which may involve playing against a dealer hand or a pay table, with payouts on wagers being paid by a casino or other gaming establishment and losses on wagers being collected by the casino or other gaming establishment. For example, payouts from the ante wager, blind wager, trips wager, and play wager are paid from house funds, and the player hand is played against the dealer hand. When a player wins in the house-banked game, on a table, the funds may be paid by a dealer using physical chips or other value tokens. On electronic embodiments, funds are awarded to the player by crediting an electronic account.

In other embodiments, the wagering games, or at least one wager associated with the wagering game, may enable players to play against one another (i.e., be "player-banked" or "player-pooled"), with payouts on wagers being paid from a pot and losses on wagers being collected by other players. Player-banked games allow a player or a professional banker to take all other player losses and pay payouts to players. In a player-banked version of a game of the present disclosure, a house may provide a dealer to administer the game and may rake wagers made, rake payouts won, or charge a flat fee for playing the game. Player-banked games are typically offered as live table games in card rooms where house-banking gaming is not permitted by local gaming regulations. Player-pooled variants of games may be offered as live table games, but are more typically offered in an electronic format, where tracking the value of a jackpot pool is conducted using computer-controlled equipment. Player-pooled variants are particularly useful when regulators of online casino play permit the play of "poker."

Figure 4:
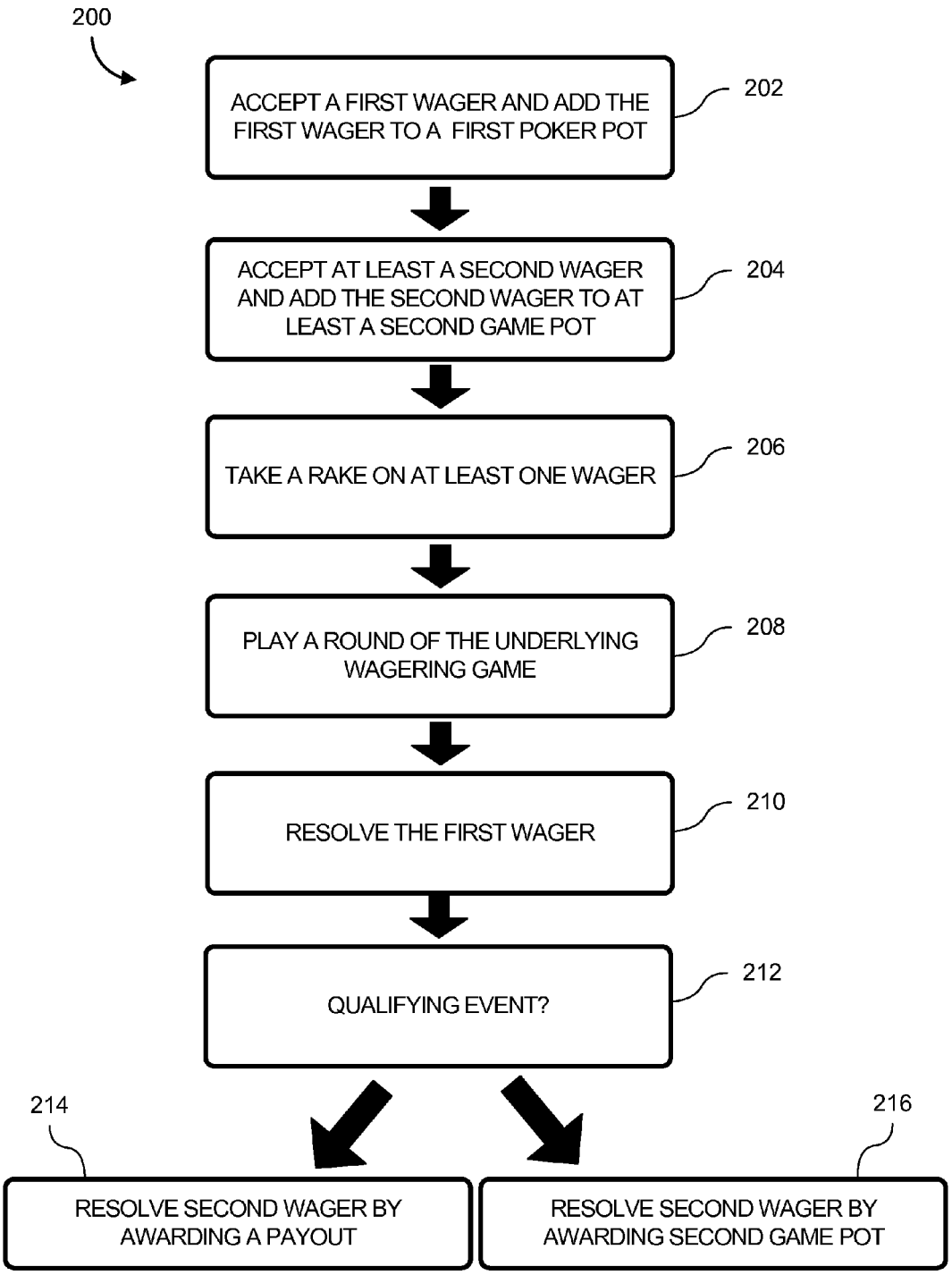
FIG. 4 is a flowchart diagram of a method of administering a wagering game that may be at least partially player-pooled.

Referring to FIG. 4, a flowchart diagram of a method 200 of administering a wagering game, which may be at least partially player-pooled, is shown. The method 200 includes accepting a first "poker" wager from a player and adding the first wager to a first poker pot (e.g., a pool or accumulation of bets), as indicated at operation 202. The wagers contributed to the poker pool may be raked in one example of the invention.

A second wager may be received at operation 204. The second wager may comprise, for example, a base game wager (e.g., ante wagers, blind wagers, play wagers, raises, and other wagers made on the underlying wagering game) or a side wager. Second wagers may be raked. Alternatively, payouts on second wagers may be raked. More specifically, the second wager may comprise, for example, the ante wager and any of the play wagers, or a separate pay table or progressive side wager. The second wager may be accepted, for example, by performing any of the acts described previously in connection with FIG. 1. In one example, the second wager may comprise all wagers made in the game of ULTIMATE TEXAS HOLD 'EM®, and the first wager may be an additional "poker" wager. The first poker pot may be non-progressive, meaning that the entire value of the pot is distributed to a player at the conclusion of a round of play. If two players tie with a highest-ranking hand, the poker pot may be split. In other embodiments, the player holding the highest-ranking hand is awarded a percentage of the pot, and a player holding a second highest-ranking hand is also awarded a percentage of the pot. An exemplary split between highest and next highest hand is 80/20, for example.

The second pot may be separate from the first pot. For example, the first and second pots may include chips located in separate areas on a gaming table when the wagering game is conducted live in a casino. As another example, the first and second pots may be displayed as separate amounts on one or more video displays (gaming screen 374 (FIG. 5), playing surface 404 (FIG. 6), player interface 416 (FIG. 6), dealer interface 418 (FIG. 6), upright display 430 (FIG. 6), player interface area 532 (FIG. 7), dealer screen 560 (FIG. 7), card display 564 (FIG. 7), and display 758 (FIG. 10)) (e.g., a monitor) controlled by one or more processors (control processor 350 (FIG. 5), local game processor 414 (FIG. 6), central game processor 428 (FIG. 6), control processor 597 (FIG. 7), and processor 742 (FIG. 10)) and may be maintained in separate accounts when the wagering game is conducted online. The second wager may enable a player to be eligible to win an additional award, such as, for example, a progressive payout for a predetermined premium hand.

In one embodiment, all odds payouts are paid out of the second pot, and all losses are accumulated in the second pot. When a predetermined event occurs, such as a player holding a predetermined premium hand, such as a royal flush in hearts, for example, the administrator of the game may, at operation 214, award the entire second pot to the player holding the premium hand.

In other embodiments, all normal game wagers, such as the ante wager and all play wagers in the present game, are placed in the second pot, and all payouts are made from the second pot. Excess amounts that grow in the pot are redistributed to players in the form of a dividend distribution (e.g., a share of the second pot awarded to each participating player), from the second pot. The second wager may comprise, for example, the ante wager or any of the play wagers.

In some embodiments, the second wager may be a mandatory wager. In other embodiments, the second wager may be optional, and a player wishing to play the poker wagering game may do so by placing a bet in the first pot without placing the second wager and without being eligible to win any award from the second pot. In some embodiments, the second wager may include multiple sub-wagers. For example, the second wager may include an ante wager, a first play wager, a second play wager, and a third play wager. In other embodiments, a third pot (not shown) for participating in a progressive side wager game is provided. Such third pots may be separate from the other pots or may be combined with one of the other pots. The second wager may be accepted, for example, by performing any of the acts described previously in connection with FIG. 1.

In some embodiments, the second pot may be a pooled or linked pot. For example, the second pot may include second wagers accepted from multiple concurrent wagering games, which may include only second wagers from those wagering games currently being played or may include accumulated second wagers from past wagering games. As specific, nonlimiting examples, the second pot may include all second wagers accepted from a group of tables or local wagering game administration devices at a casino, from multiple groups of remote devices connected to network gaming architecture, or both. In other embodiments, the second pot may not be pooled, and awards for the second wager may be limited to the amounts wagered at a respective table, local wagering game administration device, or group of remote devices.

A rake (e.g., a commission for the house) may be taken on at least one of the first and second wagers, as indicated at operation 206. For example, the house may collect a portion of the second wager at the time the second wager is placed or may collect a portion of amounts awarded from the second pot at the time the second pot or a portion of the second pot is awarded. The rake may comprise, for example, a fixed percentage of the second wager. More specifically, the percentage of the second wager collected for the rake may be, for example, greater than a theoretical house advantage for the underlying game. As another example, the rake may be less than an average house advantage for play of the wagering game by all players, including average and sub-average players, which may be calculated using a historical house advantage for the wagering game (e.g., a house advantage for the wagering game over the last five, ten, or fifteen years for a given casino or other gaming establishment). As specific, nonlimiting examples, the percentage of the second wager collected for the rake may be between 3% and 8%, between 4% and 7%, or between 5% and 6%. In other embodiments, the portion of the second wager collected for the rake may comprise a variable percentage of the second wager or may comprise a fixed quantity (e.g., a flat fee) irrespective of the total amount for the second wager, a fixed percentage with a cap, or a time-based fee for increments of time playing the wagering game.

All profits for the house may be made from the rake in some embodiments. In such embodiments, all second wagers in excess of the rake may be redistributed back to the players, rather than be collected by the house as additional revenue. Such limiting of profits for the house and redistribution of second wagers back to the players may increase the attractiveness of the wagering game to both inexperienced and highly skilled players. Because the amount earned by the house is known, highly skilled players may perceive that their skill will enable them to increase winnings, and inexperienced players may be enticed by the possibility of winning the second pot or a portion thereof. In other embodiments, the house may make profits on the rake and on losses from one or more of the wagers (e.g., ante and play wagers), including losses resulting from optimal and suboptimal play. The rake may be maintained in a rake account, and profits for the house may be deducted from the rake account. The rake may be taken by, for example, electronically transferring funds from the second pot to a rake account (e.g., as instructed by a game server 606 (see FIG. 8) using casino account servers 610 (see FIG. 8)) or physically removing or exchanging money or representations of money from the second pot on a live table.

A round of the underlying wagering game may be played, as indicated at operation 208. For example, the underlying wagering game may be played at least substantially as described previously in connection with FIGS. 1 through 3. In one embodiment, an additional side wager is played between players, rather than against a pay table. The additional side wager may be a fixed amount, such as an amount equal to the ante wager. The additional side wager is added to a first pot that is completely distributed at the end of each round of play. The distribution of the additional side wager may be based, for example, on the highest player hand at the conclusion of the game. The ante and play wagers are added to a second progressive pot for distribution based on the pay table. In this way, the first pot allows the players to compete based on hand strength against other players, while the second pot is able to support larger progressive awards based on a pay table.

At the end of a round of play, the first wager may be resolved and at least a portion of the first pot may be awarded to at least one player, as indicated at operation 210. Each successive round of making wagers, dealing cards, and resolving wagers may constitute a round of play, and the first pot or a portion of the first pot may be awarded to at least one player at the end of each round of play. The player to whom the first pot or the portion of the first pot is awarded may hold a winning hand or at least a tying hand for that round of play according to the rules of the underlying wagering game. Awarding the first pot or the portion of the first pot may comprise crediting a player account of each wining player or may comprise distributing physical money or physical representations of money to each winning player.

In some embodiments, an entire amount of the first pot may be awarded to at least one player at the end of each round of play. In such embodiments, the first pot may be a non-progressive pot. Awarding the entire first pot to at least one player at the end of each round of play may enable the wagering game to qualify as a legal form of online "poker" play under some relevant statutes. For example, games that require a mandatory pot bet that may or may not be raked, that have no house advantage, and that put all other bets into a second pot that is raked may qualify as "poker" to gaming authorities, especially for online versions of the games. Awarding the entire amount of a first pot to at least one player at the end of each round of play redistributes lost first wagers attributable to suboptimal play to other players, rather than to the house. Accordingly, such a wagering game may be particularly attractive to players who perceive themselves as being highly skilled in the wagering game and, therefore, more able to take advantage of suboptimal play by other players. In some embodiments, a portion of the first pot may be awarded to at least one player at the end of each round of play. For example, the house may take a rake on the first wager, which may still enable the wagering game to qualify as a legal form of online gambling under some relevant statutes. The rake taken may comprise, for example, between 1% and 8%, between 2% and 6%, or between 3% and 5% of the first wager. The rake amounts on each wager may be more than, less than, or equal to the rake taken on other wagers in some embodiments. In still other embodiments, a portion of the first pot may remain in the first pot or be redistributed to another pot (e.g., the second pot) to be awarded in a subsequent round of play as a progressive payout or a dividend distribution. In such an example, the portion of the wager remaining in the first pot or redistributed to another pot may comprise, for example, a fixed percentage of the first wager, a variable percentage of the first wager (e.g., an odds payout may be awarded and the remainder retained in the first pot or redistributed to the other pot), or a fixed amount.

In lieu of, or in addition to, a rake taken on one or more wagers or from winnings, the house may be compensated in a number of other ways, including, without limitation, a flat fee per round of play, a percentage of wagers made with or without a cap, rental of a player "seat," or otherwise as is known in the gaming art. All such compensation may be generally referred to as a commission.

All or portions of the second pot are distributed when there is a qualifying event, as indicated by operation 212. In embodiments in which the second pot is a progressive pot, at least a portion of the second pot may be awarded to at least one player when a predetermined non-premium winning hand combination is dealt, as indicated at operation 214, or when a premium winning hand composition is dealt, as indicated at operation 216. The second pot may not be awarded at the end of each round of play, but may grow during each successive round in which no player is dealt a premium winning hand combination. Awarding the second pot or a portion of the second pot may comprise crediting a player account with funds from the second pot or may comprise distributing physical money or physical representations of money from the pot to the player. In some embodiments involving a no-house-advantage first pot awarded at the end of each round and a progressive second pot that receives all other game bets, all players participating in the wagering game who have made the second pot wager may be eligible to win the second pot or a portion of the second pot. Players who are ineligible to win the first pot, and players who have folded but still have one or more other active bets in play, may be eligible to win the second pot or a portion of the second pot.

A predetermined winning hand combination may comprise, for example, a four-of-a-kind, a full house, a flush, a straight, a three-of-a-kind, two pair, or one pair. The hands qualifying as new winning hand combinations may be predetermined at the beginning of each round of play in some embodiments. In other embodiments, new winning hand combinations may be predetermined at the beginning of play and may remain fixed until at least one player achieves a predetermined winning hand combination, at which time new winning hand combinations may be predetermined. In still other embodiments, the hand combinations qualifying as winning hand combinations may be predetermined at the outset of the wagering game and remain fixed for the duration of the wagering game. The hands qualifying as winning hand combinations may be predetermined at random from a list of possible winning hand combinations, from among a schedule with a fixed rotation of possible winning hand combinations, or using a fixed table of winning hand combinations.

A premium winning hand composition may comprise, for example, a four-of-a-kind, a straight flush, a royal flush, or a royal flush of a certain suit. The hand compositions qualifying as premium winning hand compositions may remain fixed throughout the duration of the wagering game or may change during the wagering game. For example, after a player has achieved a premium winning hand composition, the hand compositions qualifying as premium winning hand compositions may be made more restrictive or less restrictive. As a specific, nonlimiting example, after a player has achieved a straight flush, the hand compositions qualifying as premium winning hand compositions may be restricted to royal flushes or may be expanded to include four-of-a-kinds. The hands qualifying as premium winning hand compositions may be predetermined at random from a list of possible premium winning hand compositions, following a schedule with a fixed rotation of possible premium winning hand compositions, or according to a fixed table of premium winning hand compositions.

In embodiments in which the second pot is a progressive pot, the amount awarded from the second pot for achieving a premium winning hand composition may be a progressive payout at least as great as a maximum progressive payout for achieving a predetermined winning hand composition. For example, the entire second pot may be awarded when a player or multiple players are dealt a premium winning hand composition, and only a portion of the second pot may be awarded when a player or multiple players are dealt a predetermined winning hand combination.

In embodiments, the qualifying event at operation 212 is based on a predetermined event that is not based on hand composition. In embodiments in which the amount of the second pot is adjusted using a dividend refund method, the second pot, less the rake, may be distributed among the players upon the occurrence of a predetermined event. The predetermined event may not be based, for example, on player skill or chance events occurring in the underlying wagering game. The predetermined event may comprise, for example, the expiration of a time limit or the amount of the pot reaching a certain threshold amount. The pot, which has already been raked, less a minimum seed amount, is divided pro-rata between players who are currently participating, to players who contributed to the pot, or to players according to another distribution method. The distribution can take the form of a debit to a player account, and the distribution does not take place as part of a game play event. Players may receive dividend refunds on play conducted on a live gaming table, on a game administered by an electronic gaming machine, or on a game administered by a remote gaming device.

In some embodiments, the dividend distributions may not be paid to players who have not contributed to the second pot since the last dividend distribution was paid. The percentage of the second pot, less the rake, paid to each player as a dividend distribution may be, for example, approximately equal to the percentage of hands won by each player, the percentage of first pot winnings won by each player, the percentage of total amounts wagered by each player, the proportional number of wagers made by each player, the proportional length of time spent playing the wagering game by each player, or an equal percentage for each player eligible to receive a dividend distribution from the second pot.

Alternatively, the second pot and/or any other pots may be distributed (wholly or partially) in response to a predetermined event or condition. The predetermined event or condition may be time-based, pot-based (or pool-based), game-based, or other. Further details on pot distributions based on predetermined events and conditions are disclosed in the U.S. patent application Ser. No. 13/871,824, filed Apr. 26, 2013, titled "Distributing Supplemental Pot in Wagering Games Based on Predetermined Event," (now U.S. Patent Application Publication No. 2013/0296025 A1, published Nov. 7, 2013) the disclosure of which is incorporated herein in its entirety by this reference.

In some embodiments, the second pot may be seeded with money from the rake account or reserve account at the beginning of play, after the second pot or a portion of the second pot has been awarded, or both. For example, the second pot may be seeded from the rake account of the house, and the house may maintain an amount of funds in the rake account sufficient to significantly reduce (e.g., to essentially eliminate) the likelihood that any payouts made from the rake account and any seeding amounts withdrawn from the rake account exhaust or overdraw the rake account. In some embodiments, a casino reserve account may be provided to fill the rake account in the event of an overdraw. Such seeding may incentivize players to participate in the wagering game and specifically to place the second wager to be eligible for the second pot. In addition, such seeding may reduce the likelihood that the amount of funds in the second pot may be insufficient to cover all the payouts to players. For example, where a player achieves a premium winning hand composition in one round of play, a player achieves a predetermined winning hand combination in the immediately following round of play, and a fixed odds payout is to be awarded to the player holding the predetermined winning hand combination, the amount seeded to the second pot between those rounds of play may be at least as great as the maximum fixed odds payout awardable for any predetermined winning hand combination. The second pot may be seeded each time the second pot is awarded in its entirety or each time the amount in the second pot is lower than the maximum fixed odds payout.

As a specific, nonlimiting example, a player-banked wagering game may comprise receiving an ante wager and additional side wager from a plurality of players. The additional side wager is added to a first poker pot that is not raked, has no house advantage, and is completely distributed to the players after each round. The ante wager and any subsequent play wagers may be added to a second game pot having a progressive payout for achieving a predetermined rank, such as a rank listed on a pay table as described above. After placing the ante wager and, optionally, an additional side wager, the game is played as described above. Additional wagers in the hand are added to the second pot. After completing the hand, the first pot is awarded to the player remaining in the hand with the highest hand. The second pot is a progressive pot and awards a hand that matches a pay table.

As another specific, nonlimiting example, a player-banked wagering game may comprise receiving an ante wager and additional side wager from a plurality of players. The additional side wager is added to a first pot that is not raked, has no house advantage, and is completely distributed to the players after each round. The ante wager and any play wagers are added to a second pot having a dividend payout for reaching a predetermined event. After placing the ante wager and additional side wager, the play of a game round is provided as described above. Any additional wagers are added to the second pot. After completing the hand, the first pot is awarded to the player remaining in the hand with the highest hand. The second pot is a progressive pot and awards a distribution from the second pot based on a predetermined event. The predetermined event may be selected from the group consisting of participating for a predetermined number of hands, completing a predetermined number of rounds, reaching a predetermined time limit, or reaching a predetermined amount in the second pot.

In some embodiments, wagering games may be played without risking money in connection with the wagers (i.e., "play-for-fun" games). Access to play-for-fun wagering games may be granted on a time period basis in some embodiments. For example, upon initially joining the wagering game, each player may automatically be given wagering elements, such as, for example, chips, points, or simulated currency, that is of no redeemable value. After joining, the player may be free to place wagers using the wagering elements, and a timer may track how long the player has been participating in the wagering game. If the player exhausts his or her supply of the wagering elements before a predetermined period of time has expired, the player may simply wait until the period of time passes to rejoin the game and receive another quantity of the wagering elements to resume participation in the wagering game.

In some embodiments, a hierarchy of players may determine the quantity of wagering elements given to a player for each predetermined period of time. For example, players who have been participating in the wagering game for a longer time, who have played closest to optimal strategy for the game, who have won the largest percentage of wagers, or who have won the largest quantities of wagering elements from their wagers may be given more wagering elements for each allotment of time than players who have newly joined, who have played according to poor strategy, who have lost more frequently, or who have lost larger quantities of wagering elements. In some embodiments, the hierarchy of players may determine the duration of each allotment of time. For example, players who have been participating in the wagering game for a longer time, who have played closest to optimal strategy for the game, who have won the largest percentage of wagers, or who have won the largest quantities of wagering elements from their wagers may be given shorter allotments of times to wait after exhausting their supply of wagering elements than players who have newly joined, who have played according to poor strategy, who have lost more frequently, or who have lost larger quantities of wagering elements. In some embodiments, players who have not run out of wagering elements after the period of time has expired may have the balance of their wagering elements reset for a subsequent allotment of time. In other embodiments, players who have not run out of wagering elements may retain their remaining wagering elements for subsequent allotments of time and may receive additional wagering elements corresponding to the new allotment of time to further increase the balance of wagering elements at their disposal. Players may be assigned to different categories of players, which determine the number of wagering elements awarded. In a given period of time, higher-level players or players who have invested more time playing the game may earn more wagering elements per unit of time than a player assigned to a lower level group.

In some embodiments, a player may be permitted to redeem an access token of no redeemable face value, such as, for example, points associated with a player account (e.g., social media account credits, online points associated with a transacting account, etc.), to compress the period of time and receive more wagering elements. The access tokens may be purchased or may be obtained without directly exchanging money for the access tokens. For example, access tokens may be acquired by participating in member events (e.g., completing surveys, receiving training on how to play the wagering game, sharing information about the wagering game with others), spending time participating in the wagering game or in a player account forum (e.g., logged in to a social media account), or viewing advertising. Thus, an entity administering play-for-fun wagering games may not receive money from losing player wagers or may not take a rake on wagers, but may receive compensation through advertising revenue or through the purchase of access tokens redeemable for time compressions to continue play of the wagering game or simply to increase the quantity of wagering elements available to a player.

After a player has stopped participating in a play-for-fun wagering game, any remaining quantities of the wagering elements may be relinquished by the player, in some embodiments. For example, logging out of a play-for-fun wagering game administered over the Internet may cause any remaining wagering elements associated with a respective player to be lost. Thus, when the player rejoins the play-for-fun wagering game, the quantity of wagering elements given to the player for an allotment of time may not bear any relationship to the quantity of wagering elements held by the player when he or she quit playing a previous session of the wagering game. In other embodiments, the quantity of wagering elements held by a player when stopping participation may be retained and made available to the player, along with any additional quantities of wagering elements granted for new allotments of time, when rejoining the wagering game.

Figure 5:
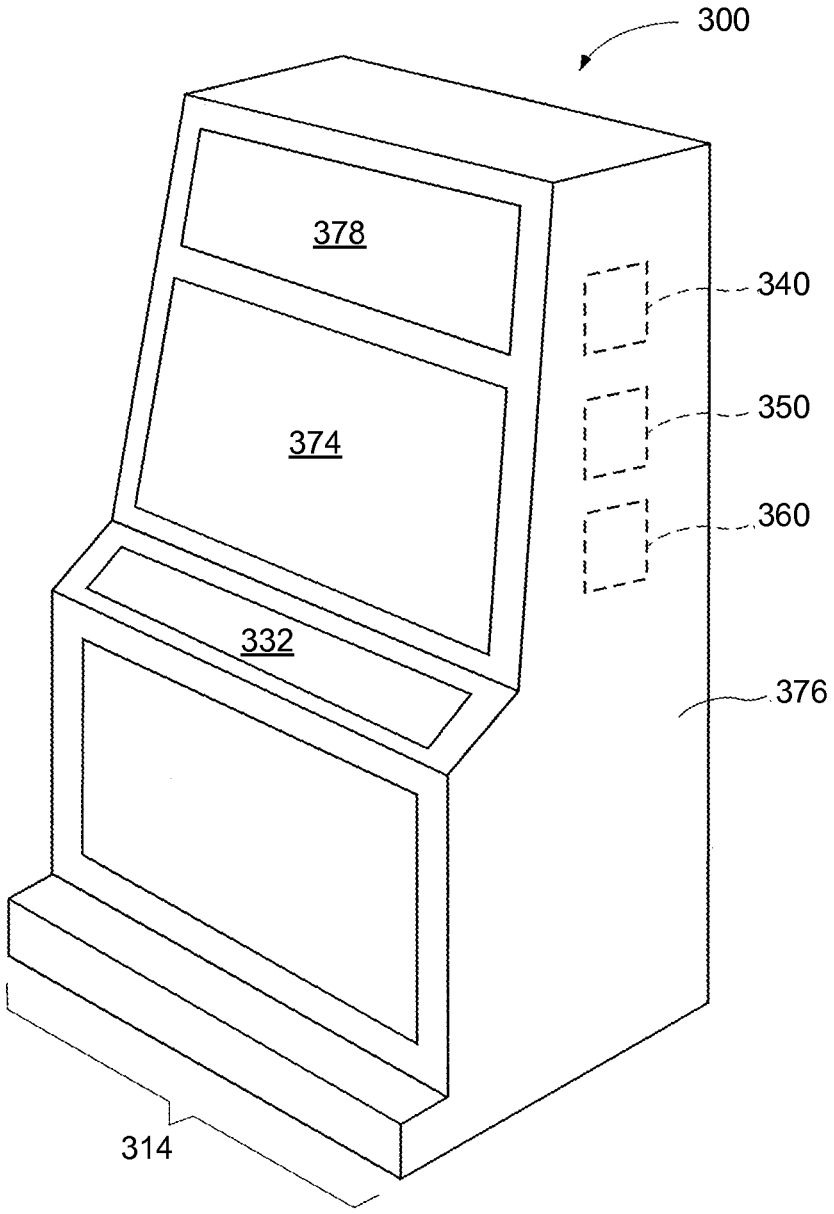
FIG. 5 is a perspective view of an individual electronic gaming device configured for implementation of embodiments of wagering games.

Referring to FIG. 5, shown is an example of an individual electronic gaming device 300 configured for implementation of embodiments of wagering games according to the present disclosure. The individual electronic gaming device 300 may include an individual player position 314 that includes a player input area 332 for a player to interact with the individual electronic gaming device 300 through various input devices (not shown). The individual electronic gaming device 300 may include a gaming screen 374 configured to display indicia for interacting with the individual electronic gaming device 300, such as through processing one or more programs stored in memory 340 to implement the rules of game play at the individual electronic gaming device 300. Accordingly, game play may be accommodated without involving physical playing cards, poker chips, and/or live personnel. The action may instead be simulated by a control processor 350 operably coupled to the memory 340 and interacting with and controlling the individual electronic gaming device 300. Although the figure has an outline of a traditional gaming cabinet, the individual electronic gaming device 300 may be implemented in any number of ways, including, but not limited to, client software downloaded to a portable device, such as a smartphone, a tablet, or a laptop personal computer. The individual electronic gaming device 300 may also be a non-portable personal computer (e.g., a desktop or an all-in-one computer) or other computing device. In some embodiments, client software is not downloaded but is native to the individual electronic gaming device 300 or is otherwise delivered with the individual electronic gaming device 300 when received by a player.

A communication device 360 may be included and operably coupled to the control processor 350 such that information related to operation of the individual electronic gaming device 300, information related to the game play, or combinations thereof may be communicated between the individual electronic gaming device 300 and other devices (not shown) through a suitable communication media, such as, for example, wired networks, Wi-Fi networks, and cellular communication networks.

The gaming screen 374 may be carried by a generally vertically extending cabinet 376 of the individual electronic gaming device 300. The individual electronic gaming device 300 may further include banners (not shown) configured to communicate rules of game play and/or the like, such as along a top portion 378 of the cabinet 376 of the individual electronic gaming device 300. The individual electronic gaming device 300 may further include additional decorative lights (not shown) and speakers (not shown) for transmitting and/or receiving sounds during game play. Further detail of an example of an individual electronic gaming device (as well as other embodiments of tables and devices) is disclosed in U.S. patent application Ser. No. 13/215,156, filed Aug. 22, 2011, (published as U.S. Patent Application Publication No. 2013/0053117 A1 on Feb. 28, 2013), now abandoned, the disclosure of which is incorporated herein in its entirety by this reference.

Some embodiments may be implemented at locations that include a plurality of player stations. Such player stations may include an electronic display screen for display of game information, such as displaying virtual cards, virtual chips, and game instructions, and for accepting wagers and facilitating credit balance adjustments. Such player stations may, optionally, be integrated in a table format, may be distributed throughout a casino or other gaming site, or may include both grouped and distributed player stations. While some features may be automated through electronic interfaces (e.g., virtual cards, virtual chips, etc.), some features may remain in the physical domain. As such, the game play may be administered by a live dealer, a virtual dealer, or a combination of both.

Figure 6:
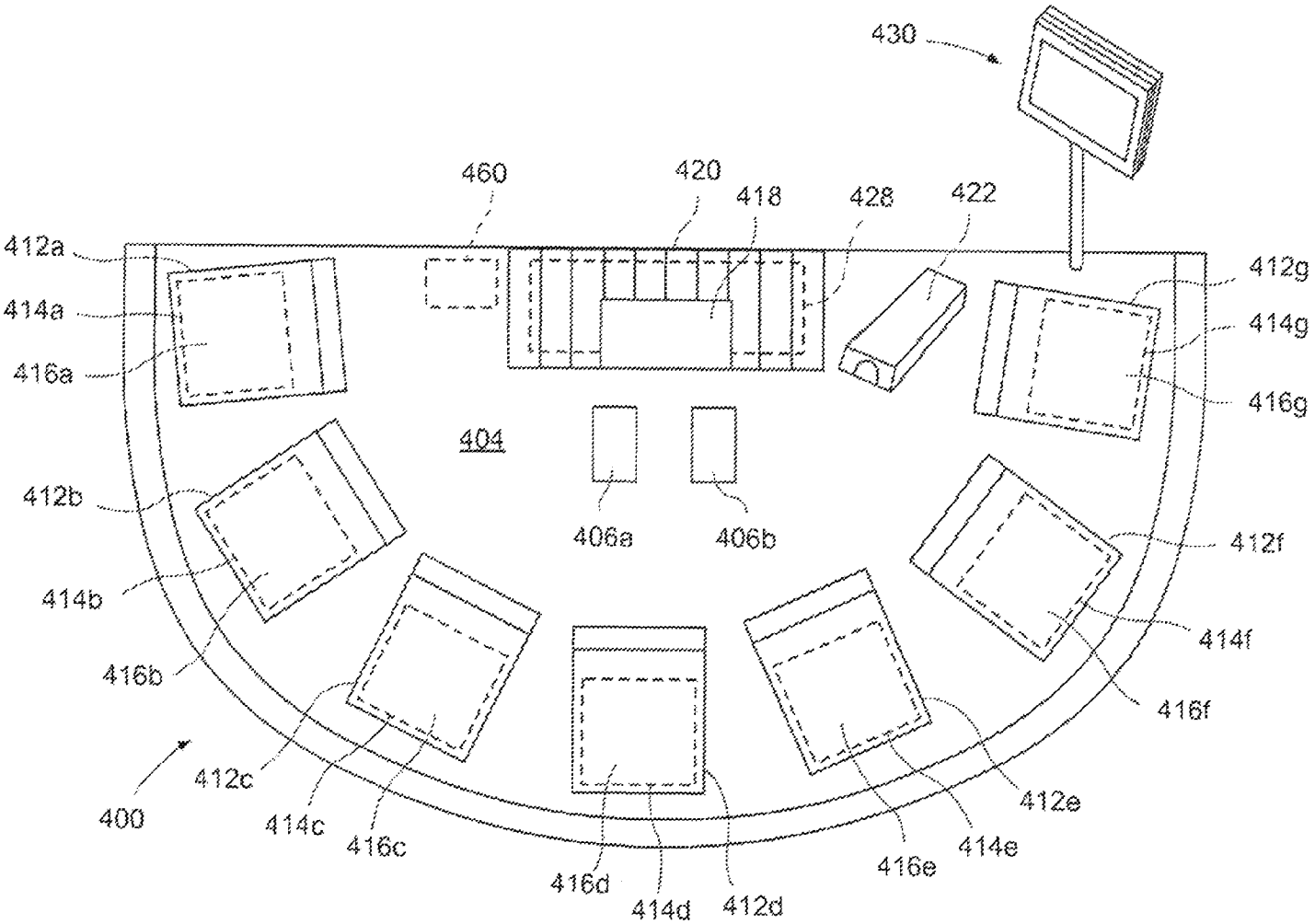
FIG. 6 is a top view of a suitable table configured for implementation of embodiments of wagering games.

Referring to FIG. 6, shown is an example of a suitable table 400 configured for implementation of embodiments of wagering games according to the present disclosure. The table 400 may include a playing surface 404. The table 400 may include a plurality of player stations 412*a* through 412*g*. Each player station 412*a* through 412*g* may include a player interface 416*a* through 416*g*, which may be used for displaying game information (e.g., game instructions, input options, wager information including virtual chips, game outcomes, etc.). The player interface 416*a* through 416*g* may include a display screen in the form of a touch screen, which may be at least substantially flush with the playing surface 404 in some embodiments. Each player interface 416*a* through 416*g* may be coupled respectively with its own local game processor 414*a* through 414*g* (shown in dashed lines), although, in some embodiments, a central game processor 428 (shown in dashed lines) may be employed and communicate directly to the player interfaces 416*a* through 416*g*. In some embodiments, a combination of the individual local game processors 414*a* through 414*g* and the central game processor 428 may be employed.

A communication device 460 (shown in dashed lines) may be included and operably coupled to one or more of the local game processors 414, the central game processor 428, or combinations thereof, such that information related to operation of the table 400, information related to the game play, or combinations thereof may be communicated between the table 400 and other devices (not shown) through a suitable communication media, such as, for example, wired networks, Wi-Fi networks, and cellular communication networks.

The table 400 may further include additional features, such as a dealer chip tray 420, which may be used by the dealer to cash players in and out of the wagering game, whereas wagers and balance adjustments during game play may be performed using virtual chips. For embodiments using physical cards 406*a* and 406*b*, the table 400 may further include a card handling device 422 that may be configured to shuffle, read, and deliver physical cards for the dealer and players to use during game play or, alternatively, a card shoe configured to read and deliver cards that have already been randomized. For embodiments using virtual cards, such virtual cards may be displayed at the individual player interfaces 416*a* through 416*g*. Common virtual cards may be displayed in a common card area (not shown).

The table 400 may further include a dealer interface 418, which, like the player interfaces 416*a* through 416*g*, may include touch screen controls for assisting the dealer in administering the wagering game. The table 400 may further include an upright display 430 configured to display images that depict game information, such as pay tables, hand counts, historical win/loss information by player, and a wide variety of other information considered useful to the players. The upright display 430 may be double sided to provide such information to players as well as to the casino pit.

Further detail of an example of a table and player displays is disclosed in U.S. Patent Application Pub. No. 2010/0016050, filed Jul. 15, 2008, published Jan. 21, 2010, titled "Chipless Table Split Screen Feature," the disclosure of which is incorporated herein in its entirety by this reference. Although an embodiment is described showing individual discrete player stations 412*a* through 412*g*, in some embodiments, the entire playing surface 404 may be an electronic display that is logically partitioned to permit game play from a plurality of players for receiving inputs from, and displaying game information to, the players, the dealer, or both.

Figure 7:
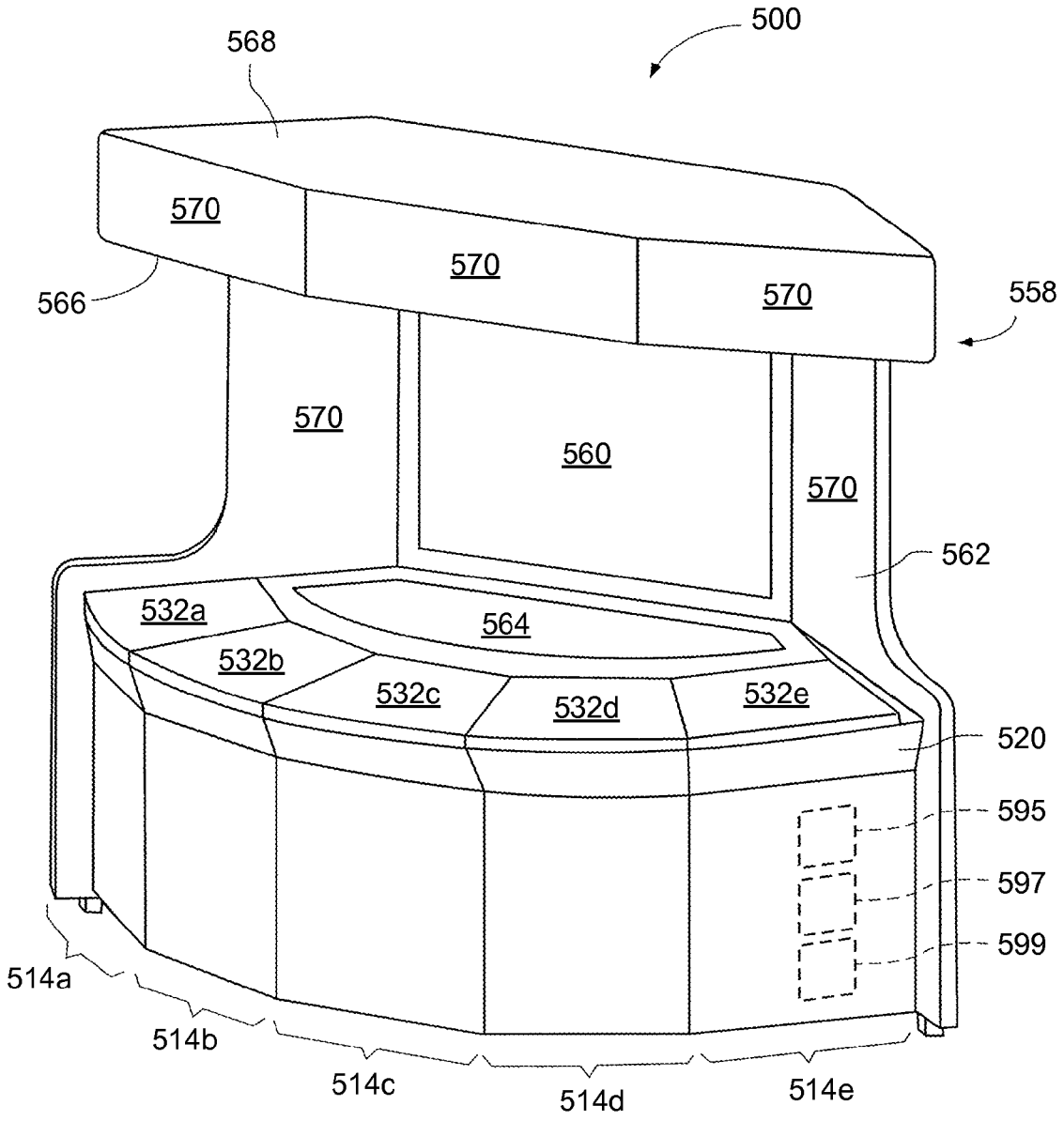
FIG. 7 is a perspective view of another embodiment of a suitable table configured for implementation of embodiments of wagering games having a virtual dealer.

Referring to FIG. 7, shown is another example of a suitable table 500 configured for implementation of embodiments of wagering games having a virtual dealer according to the present disclosure. The table 500 may include player positions 514*a* through 514*e* that are arranged in a bank about an arcuate edge 520 of a video device 558 that may comprise a card screen 564 and a dealer screen 560. The dealer screen 560 may display a video simulation of the dealer (i.e., a virtual dealer) for interacting with the video device 558, such as through processing one or more stored programs stored in memory 595 to implement the rules of game play at the video device 558. The dealer screen 560 may be carried by a generally vertically extending cabinet 562 of the video device 558. The card screen 564 may be configured to display at least one or more of the dealer's cards, the community cards, and/or the player's cards by the virtual dealer on the dealer screen 560 (virtual dealer not shown in FIG. 7).

Each of the player positions 514*a* through 514*e* may include a player interface area 532*a* through 532*e*, which is configured for wagering and game play interactions with the video device 558 and/or the virtual dealer. Accordingly, game play may be accommodated without involving physical playing cards, poker chips, and/or live personnel. The action may, instead, be simulated by a control processor 597 interacting with and controlling the video device 558. The control processor 597 may be located internally within, or otherwise proximate to, the video device 558. The control processor 597 may be programmed, by known techniques, to implement the rules of game play at the video device 558. As such, the control processor 597 may interact and communicate with display/input interfaces and data entry inputs for each player interface area 532*a* through 532*e* of the video device 558. Other embodiments of tables and gaming devices may include a control processor that may be similarly adapted to the specific configuration of its associated device.

A communication device 599 may be included and operably coupled to the control processor 597 such that information related to operation of the table 500, information related to the game play, or combinations thereof may be communicated between the table 500 and other devices (not shown) through a suitable communication media, such as, for example, wired networks, Wi-Fi networks, and cellular communication networks.

The video device 558 may further include banners (not shown) configured to communicate rules of play and/or the like, which may be located along one or more walls 570 of the cabinet 562. The video device 558 may further include additional decorative lights (not shown) and speakers (not shown), which may be located on an underside surface 566, for example, of a generally horizontally depending top 568 of the cabinet 562 of the video device 558 generally extending toward the player positions 514*a* through 514*e*.

Further detail of an example of a table and player displays is disclosed in U.S. Patent Application Publication No. 2005/0164762, filed Jan. 26, 2004, published Jul. 28, 2015, titled "Automated Multiplayer Game Table with Unique Image Feed of Dealer," (now U.S. Pat. No. 8,272,958, issued Sep. 25, 2012) the disclosure of which is incorporated herein in its entirety by this reference. Although an embodiment is described showing individual discrete player stations, in some embodiments, the entire playing surface (e.g., player interface areas 532*a* through 532*e*, the card display 564, etc.) may be an electronic display that is logically partitioned to permit game play from a plurality of players for receiving inputs from, and displaying game information to, the players, the dealer, or both.

Figure 8:
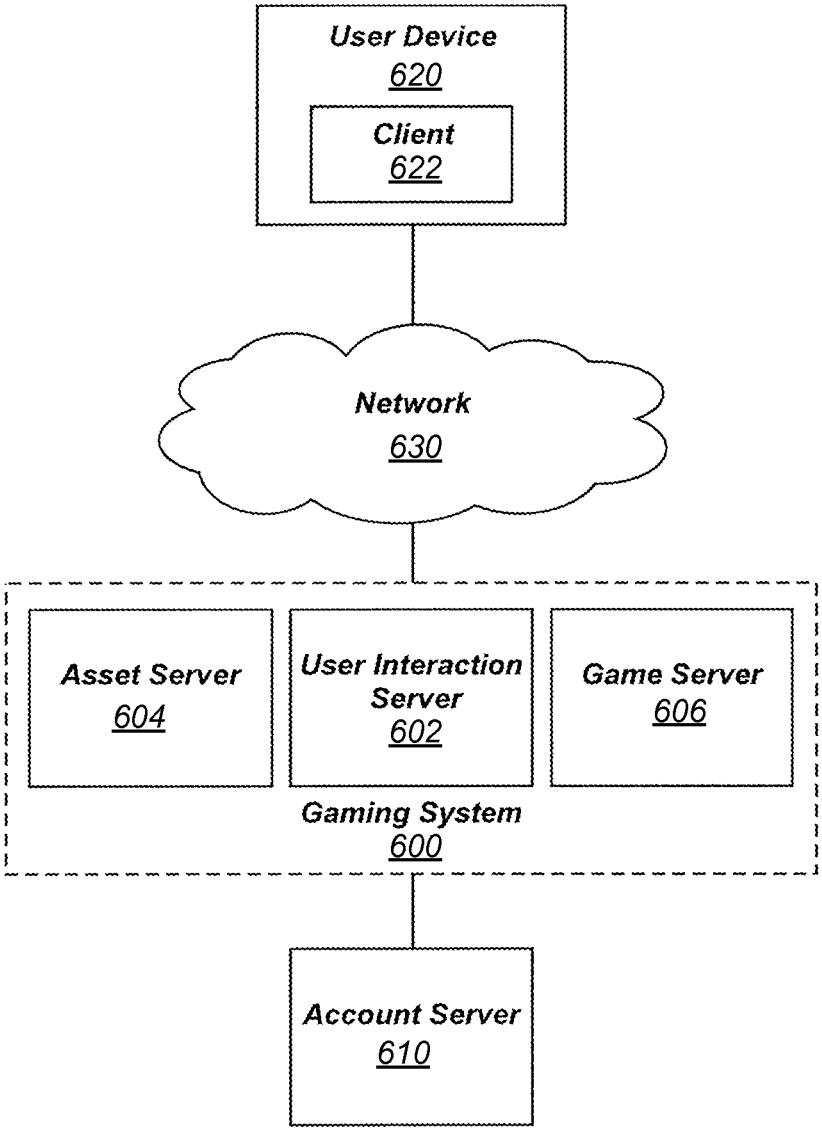
FIG. 8 is a schematic block diagram of a gaming system for implementing embodiments of wagering games.

Wagering games, in accordance with embodiments of the disclosure, may be administered over the Internet, or otherwise online, in one embodiment using a gaming system employing a client server architecture. Referring to FIG. 8, shown is a schematic block diagram of a gaming system 600 for implementing wagering games according to an embodiment. The gaming system 600 enables end users to access proprietary and/or non-proprietary game content. Such game content may include, without limitation, various types of wagering games, such as card games, dice games, big wheel games, roulette, scratch off games ("scratchers"), and any other wagering game in which the game outcome is determined, in whole or in part, by one or more random events. This includes, but is not be limited to, Class II and Class III games as defined under 25 U.S.C. §2701 et seq. ("Indian Gaming Regulatory Act"). Such games may include banked and/or non-banked games.

The wagering games supported by the gaming system 600 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, for time played in one session, or for games played; or simply being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The system may enable players to buy additional game credits to allow the player to resume play. Objects of value may be awarded to play-for-fun players, which objects of value may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 600 may include a gaming platform that establishes a portal for an end user to access a wagering game hosted by a game server 606 through a user interaction server 602. A user device 620 may communicate with the user interaction server 602 of the gaming system 600 using a network 630 (e.g., the Internet). The user interaction server 602 may communicate with the game server 606 and provide game information to the user. In some embodiments, the game server 606 may also be a game engine. In some embodiments, a single user device 620 communicates with a game provided by the game server 606, while other embodiments may include a plurality of user devices 620 configured to communicate and provide end users with access to the same game provided by the game server 606. In addition, a plurality of end users may access a single user interaction server 602, or a plurality of user interaction servers 602, to access the game server 606.

The user interaction server 602 may communicate with the user device 620 to enable access to the gaming system 600. The user interaction server 602 may enable a user to create and access a user account and interact with the game server 606. The user interaction server 602 may enable users to initiate new games, join existing games, and interface with games being played by the user.

The user interaction server 602 may also provide a client 622 for execution on the user device 620 for accessing the gaming system 600. The client 622, provided by the gaming system 600 for execution on the user device 620, can comprise a variety of implementations according to the user device 620 and method of communication with the gaming system 600. In one embodiment, the user device 620 connects to the gaming system 600 using a web browser, and the client 622 executes within a browser window or frame of the web browser. In another embodiment, the client 622 is a standalone executable on the user device 620.

In one embodiment, the client 622 may comprise a relatively small amount of script (e.g., JAVASCRIPT®), also referred to as a "script driver," including scripting language that controls an interface of the client 622. The script driver may include simple function calls requesting information from the gaming system 600. In other words, the script driver stored in the client 622 may merely include calls to functions that are externally defined by, and executed by, the gaming system 600. As a result, the client 622 may be characterized as a "thin client." As that term is used herein, the client 622 may be little more than a script player. The client 622 may simply send requests to the gaming system 600 rather than performing logic itself. The client 622 receives player inputs, and the player inputs are passed to the gaming system 600 for processing and executing the wagering game. In one embodiment, this includes providing specific graphical display information to the client 622, as well as game outcomes.

In other embodiments, the client 622 comprises an executable file rather than a script. In that case, the client 622 may do more local processing than does a script driver, such as calculating where to show what game symbols upon receiving a game outcome from the game server 606 through the user interaction server 602. In one embodiment, it may be that portions of an asset server 604 are loaded onto the client 622 and are used by the client 622 in processing and updating graphical displays. Due to security and integrity concerns, most embodiments will have the bulk of the processing of the game play performed in the gaming system 600. However, some embodiments may include significant game processing by the client 622 when the client 622 and the user device 620 are considered trustworthy or when there is reduced concern for security and integrity in the displayed game outcome. In most embodiments, it is expected that some form of data protection, such as end-to-end encryption, will be used when data is transported over the network 630. The network 630 may be any network, including, but not limited to, the Internet.

In an embodiment where the client 622 implements further logic and game control methodology beyond a thin client, the client 622 may parse and define player interactions prior to passing the player interactions to the gaming system 600. Likewise, when the client 622 receives a gaming interaction from the gaming system 600, the client 622 may be configured to determine how to modify the display as a result of the gaming interaction. The client 622 may also allow the player to change a perspective or otherwise interact with elements of the display that do not change aspects of the game.

In one form of the invention, the client 622 is part of an online casino that enables game play on the gaming system 600 by players playing on the user device 620. The client 622 provides a portal to the gaming system 600, and the player may not be aware that a game that is being played on the online casino is being administered by the gaming system 600. In other embodiments, the gaming system 600 is an integral part of the online casino. In other embodiments, the gaming system 600 is operated by a different entity than the entity that operates the online casino.

The gaming system 600 may include the asset server 604, which may host various media assets (e.g., audio, video, and image files) that may be sent to the client 622 for presenting the various wagering games to the end user. In other words, in this embodiment the assets presented to the end user may be stored separately from the client 622. In one embodiment, the client 622 requests the assets appropriate for the game played by the user; in other embodiments, especially those using thin clients, just those assets that are needed for a particular display event will be sent by the game server 606 when the game server 606 determines they are needed, including as few as one asset. In one example, the client 622 may call a function defined at the user interaction server 602 or the asset server 604, which may determine which assets are to be delivered to the client 622 as well as how the assets are to be presented by the client 622 to the end user. Different assets may correspond to the various clients that may have access to the game server 606 or to different games to be played.

The game server 606 is configured to perform game play methods and determine game play outcomes that are provided to the user interaction server 602 to be transmitted to the user device 620 for display on the end user's computer. For example, the game server 606 may include game rules for one or more wagering games, such that the game server 606 controls some or all of the game flow for a selected wagering game, as well as determining game outcomes. The game server 606 may include pay tables and other game logic. The game server 606 also performs random number generation for determining random game elements of the wagering game. In one embodiment, the game server 606 is separated from the user interaction server 602 by a firewall or other method of preventing unauthorized access to the game server 606 from the general members of the network 630.

The user device 620 may present a gaming interface to the player and communicate the user interaction to the gaming system 600. The user device 620 may be any electronic system capable of displaying gaming information, receiving user input, and communicating the user input to the gaming system 600. As such, the user device 620 can be a desktop computer, a laptop, a tablet computer, a set-top box, a mobile device, including, but not limited to, a smartphone, a kiosk, a terminal, or another computing device. The user device 620 may operate the client 622. When the user device 620 operates the client 622, the user device 620 may comprise the individual electronic gaming device 300 (see FIG. 5), as described above. The client 622 may be a specialized application or may be executed within a generalized application capable of interpreting instructions from the interactive gaming system 600, such as a web browser.

The client 622 may interface with an end user through a web page or an application that runs on a device, including, but not limited to, a smartphone, a tablet, or a general computer, or be any other computer program configurable to access the gaming system 600. The client 622 may be illustrated within a casino webpage (or other interface) indicating that the client 622 is embedded into a webpage, which is supported by a web browser executing on the user device 620.

In one embodiment, the gaming system 600 may be operated by different entities. The user device 620 and/or device housing the client 622 may be operated by a third party, such as a casino or an individual, that links to the gaming system 600, which may be operated, for example, by a wagering game service provider. Therefore, in some embodiments, the user device 620 and the client 622 may be operated by a different administrator than the operator of the game server 606. In other words, the user device 620 may be part of a third-party system that does not administer or otherwise control the gaming system 600 or the game server 606. In another embodiment, the user interaction server 602 and the asset server 604 are provided by a third-party system. For example, a gaming entity (e.g., a casino) may operate the user interaction server 602 or the user device 620 to provide its customers access to game content managed by a different entity, which may control the game server 606, amongst other functionality. In some embodiments, these functions are operated by the same administrator. For example, a gaming entity (e.g., a casino) may elect to perform each of these functions in-house, such as providing both the access to the user device 620 and the actual game content and providing administration of the gaming system 600.

The gaming system 600 may communicate with one or more external account servers 610, optionally through another firewall. For example, the gaming system 600 itself may not directly accept wagers or issue payouts. That is, the gaming system 600 may facilitate online casino gaming, but may not be part of a self-contained online casino itself. Instead, the gaming system 600 may facilitate the play of wagering games owned and controlled by a company offering games and gaming products and services, such as SHFL entertainment, Inc., now aquired by Bally Technologies, Inc. Another entity (e.g., a casino or any account holder or financial system of record) may operate and maintain its external account servers 610 to accept bets and make payout distributions. The gaming system 600 may communicate with the account servers 610 to verify the existence of funds for wagering and instruct the account server 610 to execute debits and credits.

In some embodiments, the gaming system 600 may directly accept bets and make payout distributions, such as in the case where an administrator of the gaming system 600 operates as a casino. As discussed above, the gaming system 600 may be integrated within the operations of a casino rather than separating out functionality (e.g., game content, game play, credits, debits, etc.) among different entities. In addition, for play-for-fun wagering games, the gaming system 600 may issue credits, take bets, and manage the balance of the credits according to the game outcomes, but the gaming system 600 may not permit payout distributions or be linked to the account server 610 that permits payout distributions. Such credits may be issued for free, through purchase or for other reasons, without the ability for the player to cash out. Such play-for-fun wagering games may be played on platforms that do not permit traditional gambling, such as to comply with jurisdictions that do not permit online gambling.

The gaming system 600 may be configured in many ways, from a fully integrated single system to a distributed server architecture. The asset server 604, the user interaction server 602, the game server 606, and the account server 610 may be configured as a single, integrated system of code modules running on a single server or machine, wherein each of the servers is functionally implemented on a single machine. In such a case, the functionality described herein may not be implemented as separate code modules. The asset server 604, the user interaction server 602, the game server 606, and the account server 610 may also be implemented as a plurality of independent servers, each using its own code modules running on a separate physical machine, and may further include one or more firewalls between selected servers (depending on security needs). Each server could communicate over some kind of networked connection, potentially as varied as that described for the network 630. Further, each single server shown in FIG. 8 may be implemented as a plurality of servers with load balancing and scalability factors built into the embodiment. All such embodiments and variations are fully contemplated.

Additional features may be supported by the game server 606, such as hacking and cheating detection, data storage and archival, metrics generation, messages generation, output formatting for different end user devices, as well as other features and operations. For example, the gaming system 600 may include additional features and configurations as described in U.S. patent application Ser. No. 13/353,194, filed Jan. 18, 2012, (published as U.S. Patent Application Publication No. 2013/0184079 A1 on Jul. 18, 2013) and U.S. patent application Ser. No. 13/609,031, filed Sep. 10, 2012 (published as U.S. Patent Application Publication No. 2013/0184059 A1 on Jul. 18, 2013), both titled "Network Gaming Architecture, Gaming Systems, and Related Methods," the disclosures of which are incorporated herein in their entirety by this reference.

The network 630 may enable communications between the user device 620 and the gaming system 600. A network (not shown) may also connect the gaming system 600 and the account server 610, and, further, one or more networks (not shown) may interconnect one or more of the other servers shown collectively as the gaming system 600. In one embodiment, the network 630 uses standard communications technologies and/or protocols. Thus, the network 630 can include links using technologies such as Ethernet, 802.11, worldwide interoperability for microwave access (WiMAX), 3G, digital subscriber line (DSL), asynchronous transfer mode (ATM), INFINIBAND®, PCI Express Advanced Switching, etc. Similarly, the networking protocols used on the network 630 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 630 can be represented using technologies and/or formats including the hypertext markup language (HTML), the extensible markup language (XML), etc. In addition, all or some of the links can be encrypted using conventional encryption technologies, such as secure sockets layer (SSL), transport layer security (TLS), virtual private networks (VPNs), Internet Protocol security (IPsec), etc. In another embodiment, the entities can use custom and/or dedicated data communications technologies instead of, or in addition to, the ones described above. Depending upon the embodiment, the network 630 can include links comprising one or more networks, such as the Internet.

Figure 9:
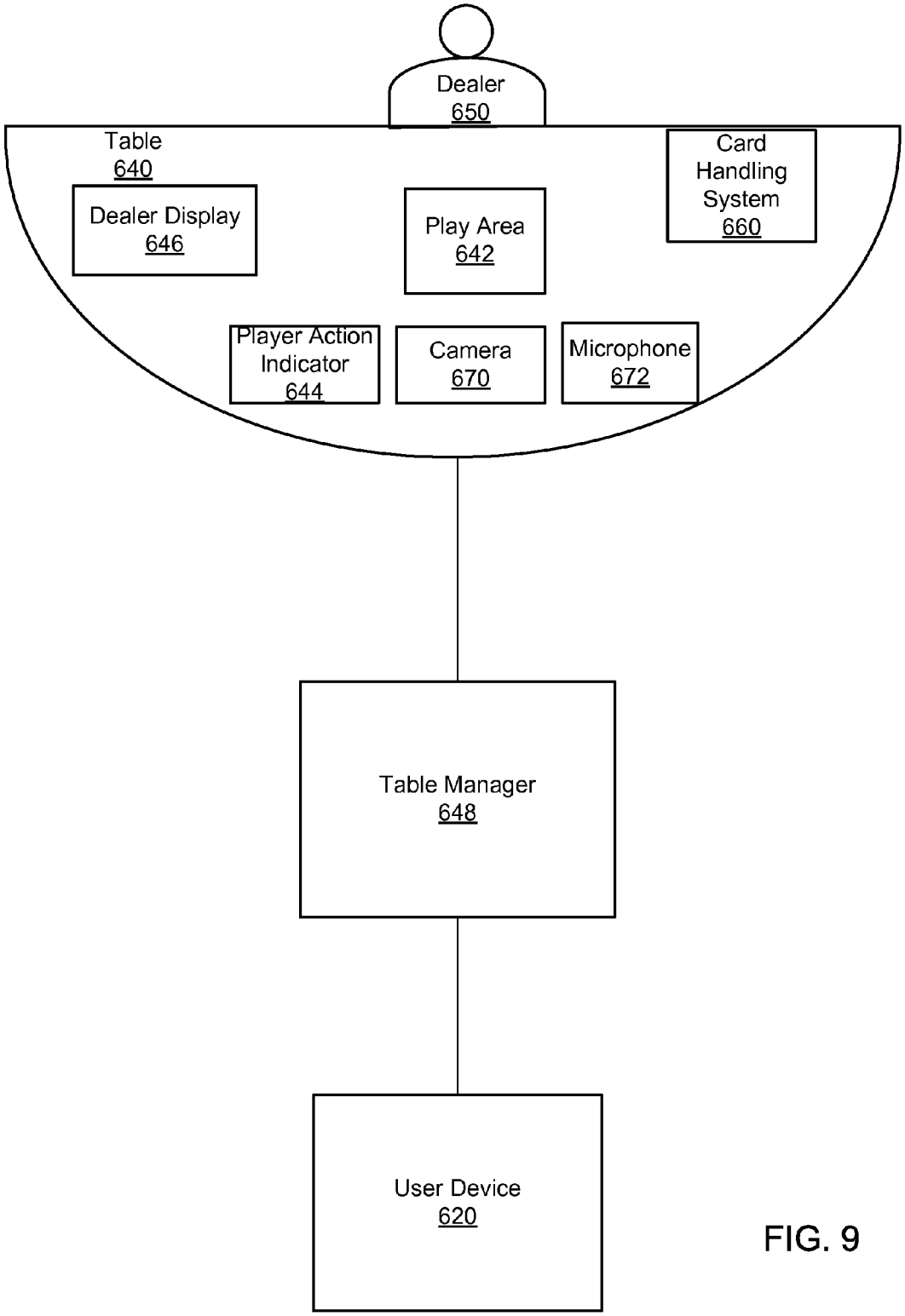
FIG. 9 is a schematic block diagram of a gaming system for implementing embodiments of wagering games including a live dealer feed.

FIG. 9 is a schematic block diagram of a gaming system for implementing embodiments of wagering games including a live dealer feed. Features of the gaming system 600 (FIG. 8) as described above are generally implemented by this embodiment, except as further described. In this embodiment, rather than cards being determined by a computerized random process, cards are dealt by a dealer 650 at a table 640 from a card handling system 660. A table manager 648 assists the dealer 650 in facilitating play of the game by transmitting a video feed of the actions of the dealer 650 to the user device 620 and transmitting player elections to the dealer 650. As described above, the table manager 648 communicates with the gaming system 600 (FIG. 8) to provide gaming at the table 640 to users of the gaming system 600. Thus, the table manager 648 communicates with the user device 620 through a network and may be a part of a larger online casino or may be operated as a separate system that facilitates game play. In various embodiments, each table 640 is managed by an individual table manager 648 constituting a gaming device, which receives and processes information relating to that table 640. For simplicity of description, these functions are described as being performed by the table manager 648, though certain functions may be performed by an intermediary gaming system 600 (FIG. 8). In some embodiments, the gaming system 600 may match players to the tables 640 and facilitate transfer of information between user devices 620 and gaming devices, such as wagering amounts and player action elections, but does not manage gameplay at individual tables 640. In other embodiments, functions of the table manager 648 are incorporated into the gaming system 600 (FIG. 8).

The table 640 includes a camera 670 and optionally a microphone 672 that capture video and audio feeds relating to the table 640. The camera 670 is trained on the dealer 650, a play area 642, and the card handling system 660. As the game is administered by the dealer 650, the player using the user device 620 is shown the video feed captured by the camera 670 and any audio captured by the microphone 672.

The card handling system 660 is typically a shuffling device, though the card handling system 660 may also be a shoe for dispensing cards. When the game play rules require cards to be dealt, the dealer 650 obtains a card from the card handling system 660 and places the card in the appropriate location in the play area 642. The play area 642 depicts player positions and any applicable card locations for playing the same, such as shown in FIGS. 2 and 3. As determined by the rules of the game, the player at the user device 620 is presented options for responding to an event in the game using the client 622, as described with reference to FIG. 8.

The user device 620 presents the options to the player and permits the player to select an election from among the options. The election is transmitted to the table manager 648, which provides player elections to the dealer 650 using a dealer display 646 and a player action indicator 644 on the table 640. The dealer display 646 and the player action indicator 644 provide information to the dealer 650 regarding the game play and elections made by players. Using the dealer display 646, for example, the dealer 650 may obtain information regarding where to deal the next card or which player position is responsible for the next action.

In one embodiment, the table manager 648 receives card information from the card handling system 660 describing cards dealt by the card handling system 660. The card handling system 660 may include a card reader that determines card information from the card. For example, the card handling system 660 may process an image of the card, or the card handling system 660 may include a barcode reader or other system for obtaining information regarding each card. The card information may include rank and suit of each dealt card, which is obtained by the card handling system 660 and transmitted to the table manager 648. The card handling system 660 may also dispense more than one card at once or identify a set of cards dispensed together as a hand. One example card handling system 660 is described in U.S. Pat. No. 8,070,574, which is hereby incorporated by reference.

Using the card information, the table manager 648 identifies hands associated with each player and, when applicable, the dealer. The table manager 648 uses the card information and identified hands, along with the elected player decisions, to determine gameplay events and, using the rules of the game, determine wager results. Alternatively, the wager results are determined by the dealer 650 and input to the table manager 648, and the wager results may be used to confirm automatically determined results by the gaming system 600 (FIG. 8). Optionally, the card information relating to cards viewable by a player is also transmitted to the user device 620 associated with the player, permitting representations of the cards to be displayed to the user in addition to the cards viewed in the play area 642.

The live video feed permits the dealer 650 to show cards dealt by the card handling system 660 and play the game as though the player were at a live casino. In addition, the dealer 650 can prompt a user by announcing a player's election is to be performed. In embodiments in which the microphone 672 is included, the dealer 650 can verbally announce action or request an election by a player. In some embodiments, the user device 620 also includes a camera or microphone, which also captures feeds to be shared with the dealer 650 and other players.

Figure 10:
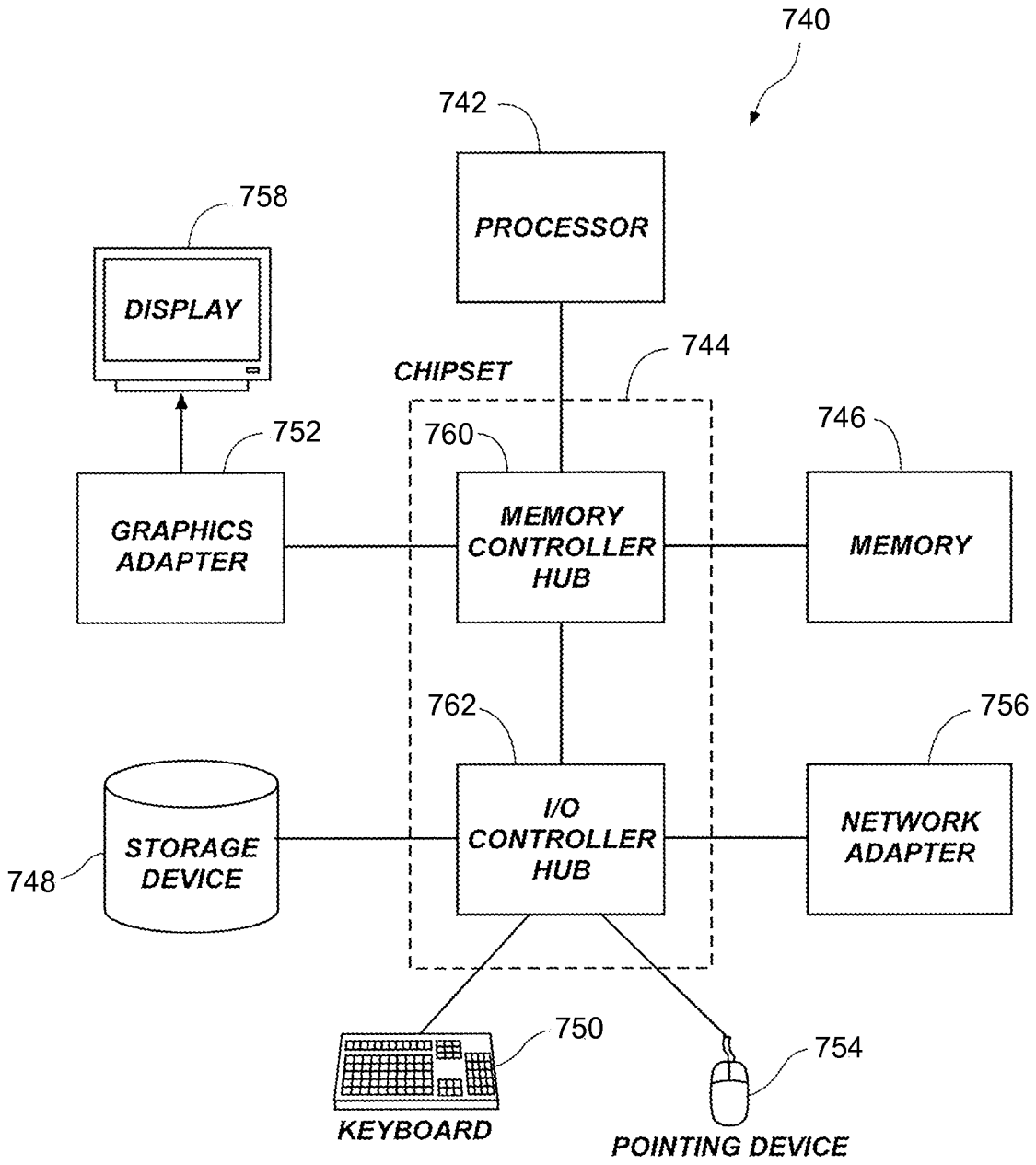
FIG. 10 is a block diagram of a computer for acting as a gaming system according to one embodiment.

Referring to FIG. 10, shown is a high-level block diagram of a computer system 740 for acting as the gaming system 600

(see FIGS. 8 and 9), according to one embodiment. Illustrated are at least one processor 742 coupled to a chipset 744, as indicated in dashed lines. Also coupled to the chipset 744 are a memory 746, a storage device 748, a keyboard 750, a graphics adapter 752, a pointing device 754, and a network adapter 756. A display 758 is coupled to the graphics adapter 752. In one embodiment, the functionality of the chipset 744 is provided by a memory controller hub 760 and an I/O controller hub 762. In another embodiment, the memory 746 is coupled directly to the processor 742 instead of to the chipset 744.

The storage device 748 is any non-transitory computer-readable storage medium, such as a hard drive, a compact disc read-only memory (CD-ROM), a DVD, or a solid-state memory device (e.g., a flash drive). The memory 746 holds instructions and data used by the processor 742. The pointing device 754 may be a mouse, a track pad, a track ball, or another type of pointing device and is used in combination with the keyboard 750 to input data into the computer system 740. The graphics adapter 752 displays images and other information on the display 758. The network adapter 756 couples the computer system 740 to a local or wide area network.

As is known in the art, the computer system 740 can have different and/or other components than those shown in FIG. 10. In addition, the computer system 740 can lack certain illustrated components. In one embodiment, the computer system 740 acting as the gaming system 600 (FIG. 8) lacks the keyboard 750, the pointing device 754, the graphics adapter 752, and/or the display 758. Moreover, the storage device 748 can be local and/or remote from the computer system 740 (such as embodied within a storage area network (SAN)). Moreover, other input devices, such as, for example, touch screens may be included.

The network adapter 756 (may also be referred to herein as a "communication device") may include one or more devices for communicating using one or more of the communication media and protocols discussed above with respect to FIG. 8.

In addition, some or all of the components of this general computer system 740 of FIG. 10 may be used as part of the processor and memory discussed above with respect to the systems of FIGS. 5, 6, and 7.

The gaming system 600 (FIG. 8) may comprise several such computer systems 740. The gaming system 600 may include load balancers, firewalls, and various other components for assisting the gaming system 600 to provide services to a variety of user devices 620 (FIGS. 8 and 9).

As is known in the art, the computer system 740 is adapted to execute computer program modules for providing functionality described herein. As used herein, the term "module" refers to computer program logic utilized to provide the specified functionality. Thus, a module can be implemented in hardware, firmware, and/or software. In one embodiment, program modules are stored on the storage device 748, loaded into the memory 746, and executed by the processor 742.

Embodiments of the entities described herein can include other and/or different modules than the ones described here. In addition, the functionality attributed to the modules can be performed by other or different modules in other embodiments. Moreover, this description occasionally omits the term "module" for purposes of clarity and convenience.

Some portions of the disclosure are presented in terms of algorithms (e.g., as represented in flowcharts, prose descriptions, or both) and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations or transformation of physical quantities or representations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "computing," "calculating," "determining," "displaying," or the like, refer to the action and processes of a computer system, or similar electronic computing device (such as a specific computing machine), that manipulates and transforms data represented as physical (electronic) quantities within the computer system memories or registers or other such information storage, transmission, or display devices.

Certain aspects of the embodiments include process steps and instructions described herein in the form of an algorithm. It should be noted that the process steps and instructions of the embodiments can be embodied in software, firmware, or hardware, and, when embodied in software, could be downloaded to reside on and be operated from different platforms used by a variety of operating systems. The embodiments can also be in a computer program product, which can be executed on a computing system.

Some embodiments also relate to an apparatus for performing the operations herein. Such an apparatus may be specially constructed for the purposes, e.g., a specific computer, or it may comprise a general-purpose computer selectively activated or reconfigured by a computer program stored in the computer. Such a computer program may be stored in a computer-readable storage medium, such as, but not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be a transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will appear from the description herein. In addition, the embodiments are not described with reference to any particular programming language. It will be appreciated that a variety of programming languages may be used to implement the teachings of the embodiments as described herein, and any references herein to specific languages are provided for the purposes of enablement and best mode.

While certain illustrative embodiments have been described in connection with the figures, those of ordinary skill in the art will recognize and appreciate that embodiments encompassed by the disclosure are not limited to those embodiments explicitly shown and described herein. Rather, many additions, deletions, and modifications to the embodiments described herein may be made without departing from the scope of embodiments encompassed by the disclosure, such as those hereinafter claimed, including legal equivalents. In addition, features from one disclosed embodiment may be combined with features of another disclosed embodiment while still being within the scope of the disclosure, as contemplated by the inventor.

The invention claimed is:

1. A method of administering a wagering game over a network, comprising:

providing a game server and a user interaction server of a gaming system;

providing, by the user interaction server, a client for execution on a user device connected to the network and associated with a player, the player being remote from the game server;

the client receiving from the user device, and communicating to the game server, an indication of an ante wager associated with the player to qualify the player to participate in the wagering game;

the client receiving from the user device, and communicating to the game server, an indication of a bonus wager associated with the player;

the gaming system adding the ante wager and the bonus wager to a game pot;

the game server determining a set of player cards defining a partial player hand including a selected number of randomized playing cards from a set of playing cards;

the game server communicating to the user interaction server the partial player hand;

the user interaction server communicating to the user device the partial player hand for display on a display associated with the user device;

the game server determining a partial dealer hand including a selected number of randomized playing cards from the set of playing cards equal to the selected number of randomized playing cards forming the partial player hand;

the game server receiving, from the client, a first game play election of a check, the first game play election input at the user device and selected by the player associated with the user device from first game play options comprising the check and a play wager election of a play wager amount not exceeding a first predetermined maximum multiple of the ante wager;

the game server determining a set of community cards including randomized playing cards from the set of playing cards;

the game server communicating to the user interaction server the set of community cards;

the user interaction server communicating to the user device the set of community cards for display on the display associated with the user device;

after receiving the first game play election of the check, the game server receiving, from the client, a second game play election input at the user device and selected by the player associated with the user device from second game play options comprising a fold and a play wager election of a play wager amount not exceeding a second predetermined maximum multiple of the ante wager;

the gaming system adding the play wager amount to the game pot;

the game server determining a poker hand for the player associated with the user device, the poker hand for the player formed from the partial player hand and the set of community cards;

the game server determining a poker hand for the dealer formed from the partial dealer hand and the set of community cards;

the game server resolving the ante wager and any play wager associated with the user device based at least in part on a comparison of the poker hand for the player to the poker hand for the dealer and determining a payout to be distributed from the game pot to the player for the poker hand for the player outranking the poker hand for the dealer; and the game server resolving the bonus wager associated with the player.

2. The method of claim 1:

further comprising, before the client receiving from the user device, and communicating to the game server, the indication of the ante wager, providing virtual wagering elements to the player associated with the user device;

wherein the client receiving from the user device, and communicating to the game server, the indication of the ante wager comprises the client receiving from the user device the indication of the ante wager, the ante wager being of an amount of the virtual wagering elements.

3. The method of claim 2, wherein providing virtual wagering elements to the player associated with the user device comprises providing play-for-fun credits to the player associated with the user device.

4. The method of claim 1, further comprising awarding a quantity of virtual wagering elements to the player associated with the user device based on a hierarchy of players.

5. The method of claim 1, further comprising:

the client receiving from the user device, and communicating to the game server, an indication of a poker wager;

the gaming system adding the poker wager to a poker pot separate from the game pot; and the game server identifying a winner of the poker pot, the winner of the poker pot being a player, of a plurality of players including the player associated with the user device, holding a highest-ranking poker hand in a round of the wagering game.

6. The method of claim 5, wherein the poker pot has no house advantage.

7. The method of claim 1, further comprising the gaming system collecting a rake on all wagers combined in the game pot.

8. The method of claim 1, wherein the game server identifying a winner of at least a portion of the game pot based on occurrence of a predetermined bonus event comprises the game server identifying the winner of at least the portion of the game pot based on a predetermined bonus event selected from the group consisting of a predetermined number of hands, a predetermined number of rounds, a predetermined time limit, and a predetermined amount in the game pot.

9. The method of claim 1, wherein the game pot is a progressive pot.

10. A system for managing play of a wagering game by a processor in communication with a plurality of remote user devices, each user device of the plurality of remote user devices associated with a player of a plurality of players, comprising:

a communication interface for communicating with the remote user devices;

a processor configured to execute instructions; and a set of the instructions stored on a non-volatile medium that, when executed by the processor, causes the processor to:

receive, from each user device of the plurality of remote user devices, an indication of an ante wager associated with a player of the plurality of players to participate in the wagering game;

add the ante wager, received from any of the plurality of remote user devices, to a game pot;

receive, from at least one user device of the plurality of remote user devices, a bonus wager;

add each received bonus wager to the game pot;

determine a plurality of partial player hands, each partial player hand of the plurality of partial player hands including a number of randomized playing cards from a set of playing cards;

provide each partial player hand to a respective user device of the plurality of remote user devices;

determine a partial dealer hand including a number of randomized playing cards from the set of playing cards equal to the number of randomized playing cards in the partial player hand;

receive, from each user device of the plurality of remote user devices a first game play election selected, during a round of the wagering game, from options including a check and a play wager of a first predetermined multiple of the ante wager;

providing, by the processor to each user device of the plurality of remote user devices, for display on each user device of the plurality of remote user devices, a set of community cards including randomized playing cards from the set of playing cards;

receiving, from each user device of the plurality of remote user devices from which the play wager was not received, a second game play election selected during the round of the wagering game, from options including a fold election and the play wager of a second predetermined multiple of the ante wager;

add the play wager, received from any of the plurality of remote user devices, to the game pot;

determine, for each player of the plurality of players, a poker player hand formed from one partial player hand, of the plurality of partial player hands, and the set of community cards;

determine a poker dealer hand formed from the partial dealer hand and the set of community cards;

resolve each received play wager based at least in part on a comparison of an associated poker player playing hand to the poker dealer hand and award at least a portion of the game pot to a player, of the plurality of players, holding an associated poker player hand that beats the poker dealer hand; and resolve the bonus wager with an award of at least a portion of the game pot based on occurrence of a predetermined bonus event.

11. The system of claim 10, wherein the ante wager is in the form of virtual wagering elements that are play-for-fun credits.

12. The system of claim 10, wherein the set of the instructions, when executed by the processor, further cause the processor to award a quantity of virtual wagering elements to the plurality of players based on a hierarchy of the players of the plurality of players.

13. The system of claim 10, wherein the set of the instructions, when executed by the processor, further cause the processor to:

receive from at least one user device, of the plurality of remote user devices, an indication of a poker wager;

pool each received poker wager in a poker pot, the poker pot having no house advantage.

14. The system of claim 10, wherein the set of the instructions, when executed by the processor, further causes the processor to collect a rake on wagers added to the game pot.

15. The system of claim 10, wherein the predetermined bonus event is selected from the group consisting of a predetermined number of hands, a predetermined number of rounds, a predetermined time limit, and a predetermined amount in the game pot.

16. The system of claim 10, wherein the game pot is a progressive pot.

* * * * *

UNITED STATES PATENT AND TRADEMARK OFFICE

CERTIFICATE OF CORRECTION

PATENT NO. : 9,129,487 B2
APPLICATION NO. : 14/034284
DATED : September 8, 2015
INVENTOR(S) : Snow et al.

It is certified that error appears in the above-identified patent and that said Letters Patent is hereby corrected as shown below:

In the specification:

COLUMN 5, LINE 7, change "at least a three-of-a-kind Players" to --at least a three-of-a-kind. Players--

Signed and Sealed this
Twenty-first Day of June, 2016

Michelle K. Lee

Michelle K. Lee
*Director of the United States Patent and Trademark Office*